US009988889B2

(12) United States Patent
Carlson et al.

(10) Patent No.: US 9,988,889 B2
(45) Date of Patent: Jun. 5, 2018

(54) PNEUMATIC SYSTEM AND PROCESS FOR FRACTURING ROCK IN GEOLOGICAL FORMATIONS

(71) Applicant: Rock Hill Propulsion, Inc., Reno, NV (US)

(72) Inventors: Russell W. Carlson, Reno, NV (US); John H. Snow, Reno, NV (US); Dustin C. Barr, Reno, NV (US)

(73) Assignee: Rock Hill Propulsion, Inc., Reno, NV (US)

( * ) Notice: Subject to any disclaimer, the term of this patent is extended or adjusted under 35 U.S.C. 154(b) by 454 days.

(21) Appl. No.: 14/537,671

(22) Filed: Nov. 10, 2014

(65) Prior Publication Data

US 2015/0129230 A1 May 14, 2015

Related U.S. Application Data

(60) Provisional application No. 61/901,922, filed on Nov. 8, 2013, provisional application No. 61/901,916, filed on Nov. 8, 2013.

(51) Int. Cl.
*E21B 43/26* (2006.01)
*E21B 43/00* (2006.01)
(Continued)

(52) U.S. Cl.
CPC ..... *E21B 43/26* (2013.01); *E21B 43/00* (2013.01); *E21B 43/168* (2013.01); *E21B 43/263* (2013.01); *E21B 47/12* (2013.01)

(58) Field of Classification Search
None
See application file for complete search history.

(56) References Cited

U.S. PATENT DOCUMENTS 3,042,115 A * 7/1962 Brandon ..... E21B 43/003 116/DIG. 22
3,062,294 A 11/1962 Huitt et al.
(Continued)

FOREIGN PATENT DOCUMENTS

WO WO-2009/140635 A1 11/2009

OTHER PUBLICATIONS

GasGun, Propellant Stimulations, www.TheGasGun.com, (see "Date Information" section below for more information) (41 pp.).
(Continued)

*Primary Examiner* — Shane Bomar
(74) *Attorney, Agent, or Firm* — Holland & Hart, LLP

(57) ABSTRACT

A tunable pneumatic fracturing system and process useable in some instances to extract oil and gas. Some embodiments provide a pneumatic fracturing tool with an elongated body that (a) contains (i) a propellant supply source intermediate opposed propellant gas discharge assemblies, (ii) a control system, and (iii) a communications port, and (b) has roller assemblies at opposed ends of the body. The tool can be tuned to provide gas pulse amplitudes and frequencies that react with the resonant frequency or other aspect of an adjacent earth formation. Some tool embodiments can variably sweep a rock formation and adjust the pressure pulse amplitude and frequency to disrupt the formation in a more productive manner. Some tools can penetrate vertical bore wells as well non-vertical bore wells. In some systems, the tool is transported and operated by a control truck and can be commanded to download operational data during or after use.

54 Claims, 18 Drawing Sheets

(51) Int. Cl.

| | |
|---|---|
| ***E21B 43/16*** | (2006.01) |
| ***E21B 47/12*** | (2012.01) |
| ***E21B 43/263*** | (2006.01) |

(56) References Cited

U.S. PATENT DOCUMENTS

| | | | | |
|---|---|---|---|---|
| 3,303,880 | A * | 2/1967 | Scott | E21B 43/26 166/280.1 |
| 3,318,395 | A * | 5/1967 | Messmer | E21B 29/02 166/223 |
| 3,674,093 | A * | 7/1972 | Reese | E21B 43/263 166/299 |
| 3,713,393 | A * | 1/1973 | O'Connor | E21B 43/1185 102/202 |
| 4,081,031 | A * | 3/1978 | Mohaupt | E21B 43/263 102/301 |
| 4,226,475 | A * | 10/1980 | Frosch | E21C 25/60 134/17 |
| 4,798,244 | A | 1/1989 | Trost | |
| 5,456,425 | A * | 10/1995 | Morris | F02K 9/805 244/3.22 |
| 5,927,329 | A * | 7/1999 | Yie | A62C 31/02 137/624.13 |
| 6,250,388 | B1 | 6/2001 | Carmi | |
| 6,817,298 | B1 * | 11/2004 | Zharkov | E21B 43/006 102/288 |
| 7,640,857 | B2 | 1/2010 | Kneisl | |
| 7,882,895 | B2 | 2/2011 | Kabishcher et al. | |
| 8,522,863 | B2 | 9/2013 | Tiernan et al. | |
| 8,721,980 | B2 * | 5/2014 | Peters | C01B 21/20 422/129 |
| 2006/0102342 | A1 * | 5/2006 | East | E21B 43/26 166/250.1 |
| 2008/0271923 | A1 * | 11/2008 | Kusko | E21B 4/02 175/25 |
| 2011/0259230 | A1 * | 10/2011 | Sawka | F02K 9/95 102/374 |
| 2013/0161007 | A1 | 6/2013 | Wolfe et al. | |
| 2013/0220598 | A1 | 8/2013 | Palumbo et al. | |
| 2013/0341026 | A1 * | 12/2013 | Alifano | E21B 36/02 166/299 |
| 2016/0084009 | A1 * | 3/2016 | Robertson | E21B 23/02 175/45 |

OTHER PUBLICATIONS

Plasma Pulse Enhanced Oil Recovery Technology, Propell Technologies Group, Inc., Novas Energy, Aug. 2014 (14 pp.).

Unlocking America's Petroleum, Propell Technologies Group, Inc., Oct. 2014 (28 pp.).

International Search Report and Written Opinion, PCT/US2014/064863, dated Jul. 9, 2015 (12 pp.).

* cited by examiner

Simiplied Actuation Model Inputs:

- Second Order Transfer Function
- Velocity Saturation Limit
- Acceleration Saturation Limit
- Position Limits
- Linearized Frequency Response

System Actuation Model Inputs:

- Rocket Motor Ballistics (1-D, Conservation of Mass)

PNEUMATIC SYSTEM AND PROCESS FOR FRACTURING ROCK IN GEOLOGICAL FORMATIONS

CROSS-REFERENCE TO RELATED PATENT APPLICATIONS

This claims the benefit of U.S. Provisional Pat. App. No. 61/901,916, titled "Pneumatic Shearing Tool, System, and Method of Use," filed on 8 Nov. 2013, and U.S. Provisional Pat. App. No. 61/901,922, titled "Pneumatic Shearing Tool, System, and Method of Use," filed on 8 Nov. 2013, the entire contents of which are incorporated by reference into this document. In the event of a conflict, the subject matter explicitly recited or shown in this document controls over any subject matter incorporated by reference. The incorporated subject matter should not be used to limit or narrow the scope of the explicitly recited or depicted subject matter.

APPLICANTS' VIEW OF SOME ASPECTS OF THE PRIOR ART

Hydraulic fracturing ("fracking") has long been used in conjunction with deep well horizontal drilling and well completion techniques to procure oil, gas, and geothermal fluid. Fracking refers to the procedure of creating fractures in rocks and rock formations by injecting fluid into cracks to force them further open. The larger fissures allow more oil and gas to flow out of the formation and into the wellbore, from where it can be extracted. The fracking process takes place under tight regulatory control.

Fracking makes it possible for shale oil extraction to produce oil and natural gas in places where conventional technologies are ineffective. As a result, fracking has played an important role in the development of America's oil and natural gas resources for nearly 60 years. It has been estimated that over one million wells have been hydraulically fractured since the first well in the late 1940s, with 35,000 wells are being processed by fracking in the U.S. today.

Fracking, however, requires large amounts of water to accomplish the "frack." Water is used for pressurizing the well to fracture the rock strata, thus enhancing the permeation of oil/gas through the rock formation to the well bore. This process, called well "completion," typically requires use of millions of gallon of water per well.

Typical hydraulic fracturing techniques also combine chemicals and debris with the water, which raises potential environmental concerns for the post-process water matrix. The fracking process thus commonly not only requires great quantities of water and stored energy to pressurize the water but also requires the operator to clean the water after the hydraulic fracturing process is completed. The water cleansing process is expensive and poses a logistical problem, particularly in remote areas of the country where hydraulic fracturing most commonly Occurs.

In addition, there has been much public opposition to hydraulic fracking due to perceived environmental hazards caused by fracturing rock, water usage, water contamination, and seismic activity. Many of the chemicals used in fracking are not required to be identified by regulatory agencies, which causes concern that these unidentified chemicals are migrated into and polluting the ground water. These environmental concerns have caused restraint of some fracking activities, particularly in foreign countries. Some countries have even banned the use of hydraulic fracturing.

The objective of hydraulic fracturing is to create fractures perpendicular to the least principal in situ stress. The hydraulic fracture can propagate vertically as well as laterally, however, as the water matrix seeks paths of least resistance. Undesired vertical propagation has caused many hydraulic fractures to break out of the rock formation and penetrate aquifers and thief zones.

Another hydraulic extraction technique is steam injection. There are several different forms of the technology, two of which are cyclic steam stimulation and steam flooding. Both are most commonly applied to oil reservoirs that are relatively shallow and that contain crude oils, which are quite viscous at the temperature of the native underground formation. The steam injection process inherently requires a steam generation plant with attendant costly infrastructure footprint, equipment, energy, and manpower to operate.

One alternative to hydraulic fracking and steam injection is the "Gas Gun" fracking technique. The GasGun uses solid propellant, often referred to as a low explosive, to generate high pressure gas at a rapid but fixed rate. The time to peak pressure is approximately 10,000 times slower than explosives and 10,000 times faster than hydraulic fracturing. The rate is rapid enough to create multiple fractures radiating 10 to 50 feet from the wellbore, but not so rapid as to pulverize the rock as is experienced with classic high explosives such as nitroglycerine. The star-shaped pattern of multiple fractures removes wellbore damage or blockage and increases rock formation permeability near the wellbore.

As a result, the GasGun can be substantially more effective than hydraulic fracking in creating fractures, bypassing nearbore damage, increasing formation permeability, and providing fractures are much less likely to wander out of the producing zone. Although the GasGun can be a more economical and effective alternative to hydraulic fracking, requires much less on-site equipment, and can replace small to medium hydraulic fracture treatments in particular, the applicants believe that the Gas Gun has limited effect in that the predetermined pressure pulse device and concept of operation is comparatively inefficient, time consuming, and unduly expensive due to the inability to readily vary the type of pulse with the Gas Gun.

Another oil extraction technique is the plasma pulse process. The plasma pulse process utilizes a down-hole plasma pulse tool lowered into vertical wellbores to the perforated oil-producing zone. The plasma pulse tool delivers metallic plasma-generated, directed, non-linear, wide-band elastic oscillations at specified resonance frequencies to enhance oil production. The plasma pulse tools only work in vertical wells, not horizontal wells, with a minimum of 5½-inch casings.

BRIEF SUMMARY OF SOME ASPECTS OF THIS SPECIFICATION

The applicants believe that they have discovered, or discovered the scope of, at least some of the problems and issues with prior art systems such as noted, for example, in the Aspects section above. The applicants have therefor developed a multi-pulse, tunable pneumatic fracturing system (alternately referred to as a shearing system) and process.

In some embodiments, the pneumatic fracturing system is tuned to provide pulse amplitudes and frequencies that react with the resonant frequency of an adjacent earth formation or component of the formation, such as an adjacent rock formation for example. This can result in force magnification and resonance disruption of the adjacent earth. In some applications, the pneumatic fracturing tool can variably sweep the pressure regimes of the rock and adjust the pressure pulse amplitude and frequency to disrupt the formation in a more productive manner.

Some pneumatic fracturing systems can supplant or enhance current fracking or other gas or oil extraction processes. Some embodiments can be one more among inherently less environmentally obtrusive, less consumptive of water, less complex, less costly, and more productive than prior art extraction processes.

Some pneumatic fracturing systems can penetrate vertical bore wells as well non-vertical bore wells, such as horizontal bore wells for example. Some such systems can thus penetrate a first bore well extending downwardly and, from the first bore well, continue on to penetrate an offshoot well extending at an angle from the first bore well. Some pneumatic fracturing tools can activate in a downwardly extending well, an offshoot well, or when in either.

Some pneumatic fracturing systems utilize a multi-pulse, tunable pneumatic fracturing tool. Certain such systems include a field command and control software station in communication with such a tool. An operator can program the tool to generate pulsed energy output at frequencies or other intervals specific to physical characteristics of the material surrounding the too.

In some embodiments, after the pneumatic fracturing tool has been deployed and activated, it can be retrieved and interrogated or commanded to down loading post-operational telemetry data. Some such systems can thereby report efficacy of the operation such as, for example, an assay of physical characteristics in the formation.

In some cases, the pneumatic fracturing tool includes a laterally extending housing assembly or body, a laterally extending gas jet deployment assembly mounted in the housing assembly, and a gas jet generation assembly mounted in the housing assembly. Some pneumatic fracturing tools include a gas jet generation assembly mounted in the housing assembly between two opposed gas jet deployment assemblies. In some systems, the gas jet deployment system includes a first set of one or more gas jets mounted in the housing assembly opposite, and facing 180° away from, a second set of one or more gas jets. In some systems, the gas jet deployment includes at least three sets of jets spaced from each other, such as at 120° apart, on the outer periphery of the housing assembly.

In some instances, the pneumatic fracturing tool also includes an outer housing, roller assemblies, and roller assembly couplings. Some roller assemblies are coupled via roller assembly coupling to opposed ends of the pneumatic fracturing tool. The tool may also include an outer housing enclosing and protecting the internal components, such as, in some embodiments, potentially sensitive electronic equipment from, for example, extreme down hole environmental conditions including high pneumatic and hydraulic pressures and high temperatures.

Some embodiments of the pneumatic fracturing tool include one or more hot gas control valves and solid propellant fuel that, when ignited and burned, ejects as high pressure gas from the jet(s) for use in disrupting shale formations. One more such control valves can be an adjustable proportional linear-positioned hot gas valve. In certain such systems, the fracturing tool components can be encased within a protective outer casing, and the high pressure pulses eject from through perforations in the protective casing.

In some cases the pressure pulsing can be biased or fluctuated along the length of the pneumatic fracturing tool. In some applications, this can create a secondary coupling of shock waves within the formation (more energetic fracturing), or a secondary waveform within the shale formation, creating a residual pumping action as the wave form dissipates. These shear waves are intended to create a displacement effect within the fracture zones. Some applications of such shear waves can enhance permeability passageways by wedging open the shear plane of the fractures.

A number of representative embodiments are provided to illustrate the various features, characteristics, and advantages of the disclosed subject matter in the context of oil and gas extraction. It should be understood, however, that many of the novel features disclosed in this specification may be used in a variety of other settings, situations, and configurations. In addition, the features, characteristics, advantages, etc., of one embodiment can be used alone or in various combinations and sub-combinations with one another.

This Brief Summary thus introduces only some features further described in the Detailed Description. Other novel features and advantages will become apparent as the specification proceeds. Thus, the Aspects and Brief Summary sections are not intended to identify key or essential aspects of the disclosed subject matter, nor should they be used to constrict or limit the scope of the claims.

BRIEF DESCRIPTION OF THE DRAWINGS

The applicants' preferred and other embodiments are disclosed in association with the accompanying drawings in which.

DETAILED DESCRIPTION OF SOME EMBODIMENTS

A pneumatic fracturing system 50 uses pressurized gas to fracture or disrupt adjacent earth, such as rock in geological formations. Some embodiments of the pneumatic fracturing system 50 can be used to supplant or enhance one or more fracking processes currently employed in the oil/gas industry. The pneumatic fracturing system 50 can be generally less environmentally damaging, less logistically complex, less operationally costly, and more efficient than current fracking methods.

The pneumatic fracturing system 50 provides a number of advantages compared to conventional fracking. For example, the pneumatic fracturing system 50 uses very little water relative to traditional fracking methods. High water use is one of the major concerns with conventional fracking. Reducing the amount of water goes a long ways toward addressing public concern over the detrimental environmental effects of fracking.

The logistics of deploying the pneumatic fracturing system 50 at a well site are considerably simpler than for a fracking operation. Hydro-fracking requires a large surface footprint that can accommodate numerous trucks, pumping equipment, work crew accommodations, roads, and the like. The large size of the operation produces a concomitantly large carbon footprint. The pneumatic fracturing system 50 by contrast does not require significant infrastructure and logistics to deploy. In one embodiment, the pneumatic fracturing system 50 can be operated with one support truck and a light crew, thereby drastically reducing the cost and time required to enhance an oil/gas shale deposit for production.

The pneumatic fracturing system 50 is generally used to fracture deep well rock/shale strata to enhance the extraction and/or production of natural resources such as oil, gas, geothermal, injection, or water wells. The pneumatic fracturing system provides a discriminating and cost effective way to enhance production of such wells.

The pneumatic fracturing system 50 can be configured to fracture a rock formation in a variety of ways. In one embodiment, the pneumatic fracturing system 50 provides multiple pulses of high pressure gas into the rock in the bore hole. The pneumatic fracturing system 50 can control the amplitude and/or frequency of the pulses applied to a given rock formation. For example, the pneumatic fracturing system 50 can be programmed to have a duty cycle or pulse profile that maximizes fracturing in a given formation. This makes the pneumatic fracturing system 50 flexible and adaptable to various geological formation and/or well bore fracturing objectives.

Figure 1:
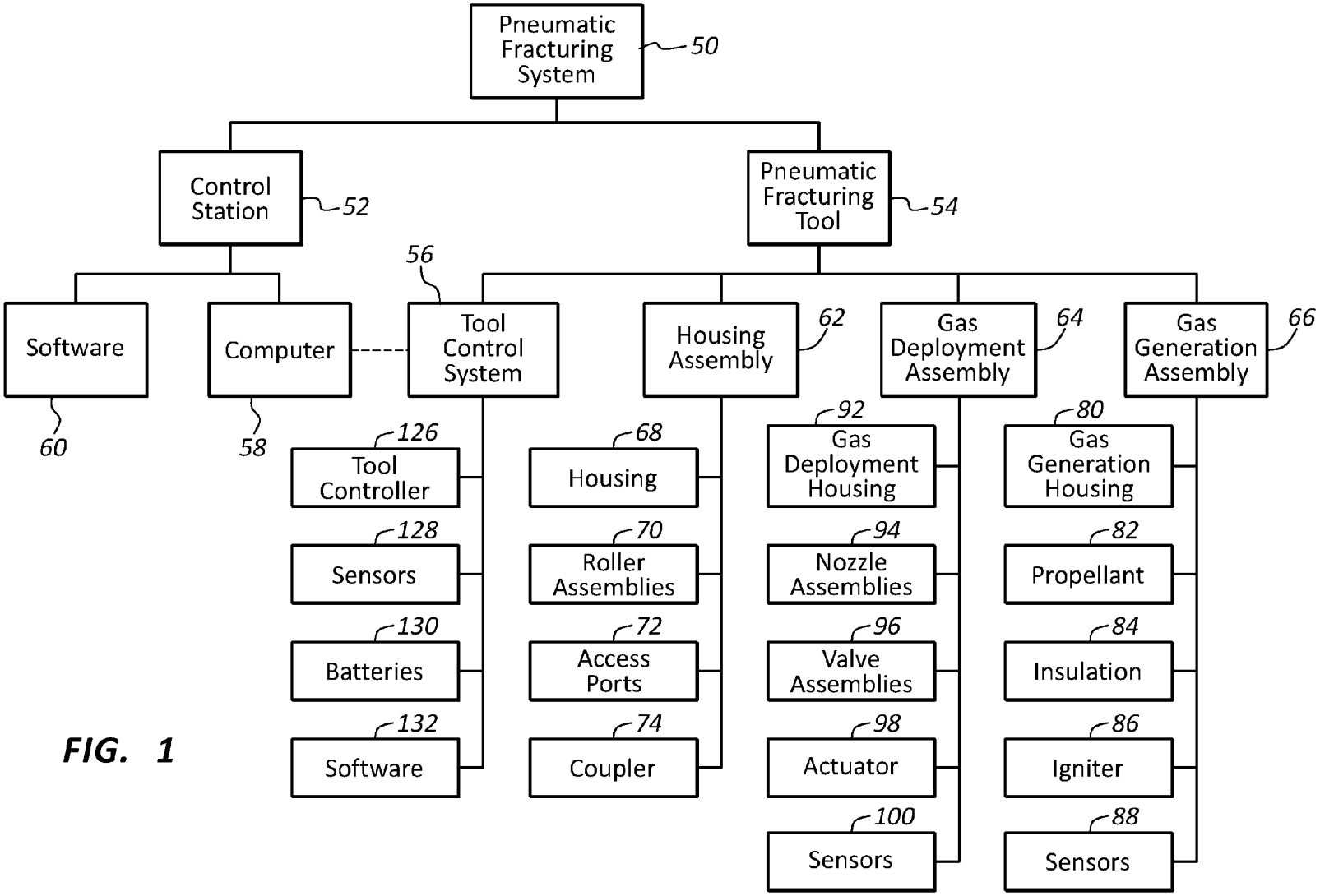
FIG. 1 is a diagram showing the design of one embodiment of a pneumatic fracturing system.

FIG. 1 shows one embodiment of a pneumatic fracturing system 50 including a control station 52 (alternatively referred to as a command station) and a pneumatic fracturing tool 54 (alternatively referred to as a pneumatic shearing tool or down hole tool). It should be appreciated that the pneumatic fracturing system 50 can have any of a number of suitable configurations beyond what is shown in FIG. 1. For example, the pneumatic fracturing system 50 can include multiple pneumatic fracturing tools 54 controlled by a single control station 52.

Control Station

The control station 52 can have any suitable configuration and combination of components. In one embodiment, the control station 52 is configured to remain on the surface near the drill hole. In another embodiment, the control station 52 is positioned remotely from the drill site such as at a central command center.

The control station 52 can be configured to communicate with and/or control the pneumatic fracturing tool 54 before, during, and after fracturing the rock formation. In one embodiment, the control station 52 includes a computer 58 that can communicate with the pneumatic fracturing tool 54 and/or perform other processing tasks.

The computer 58 can be any suitable computer running any suitable operating system. For example, the computer 58 can be a desktop, laptop, tablet, smartphone, or the like. The computer 58 can be a standard off-the-shelf device or can be specially designed and ruggedized for the harsh environment encountered at a drill site. The computer 58 can use any suitable operating system and run any suitable software. In one embodiment, the computer 58 runs Windows, Linux, iOS, Android, or other suitable operating systems.

The control station 52 includes software 60 that can run on the computer 58 or any other suitable computing device. For example, the software 60 can be Internet based software that is accessed using an Internet browser installed on the computer 58.

The software 60 can be used to program and/or control the operation of the pneumatic fracturing tool 54. For example, the software 60 can be used to program the duty cycle (pressure amplitude and time for each pulse) of the pneumatic fracturing tool 54 to best meet the requirements for optimal fracturing of a given rock formation. The software 60 can also be used to initiate the fracturing process when the pneumatic fracturing tool 54 is positioned in the hole.

It should be appreciated that the software 60 can include one or more programs written in any suitable programming language and having any suitable interface. In one embodiment, the software 60 includes a user friendly graphical user interface that allows the user to quickly and easily program the duty cycle and/or otherwise control the operation of the pneumatic fracturing tool 54.

The control station 52 can be used in connection with the pneumatic fracturing tool 54 in a number of ways. In one embodiment, the on-site operator can use the computer 58 to program the duty cycle for the pneumatic fracturing tool 54. Once the duty cycle has been created, the file is loaded into the tool control system 56 as shown by the dotted line between the computer 58 and the tool control system 56 in FIG. 1.

The computer 58 can communicate with the tool control system 56 wirelessly via Bluetooth, Wifi, Zigbee or other suitable wireless protocols. The computer 58 can also be physically connected to the tool control system 56 by way of a cable such as a USB cable, Ethernet cable, or the like.

The duty cycle can provide a wide variety of output gas pressures at various frequencies. In one embodiment, the duty cycle is selected to correspond to the physical characteristics of the down hole rock species. Specifically, the duty cycle is custom programmed or selected to provide the energy output that produces the most advantageous fracture of the rock species. In another embodiment, the duty cycle can be one of a number of preprogrammed duty cycles that correspond to common rock species. For example, the duty cycle can be selected from a list of common duty cycles, such as from four to one hundred such cycles and any smaller range from four to one hundred duty cycles.

The control station 52 can also be used to retrieve data from the pneumatic fracturing tool 54 during and/or after it has been deployed and activated in the well hole (e.g., real-time data and/or data stored for later retrieval). The data includes information about the effectiveness of the fracturing operation and the physical characteristics of the formation. This information can be used to tune the duty cycle of the pneumatic fracturing tool 54 to make the next deployment more effective.

Tuning the duty cycle refers to making the duty cycle more in harmony with the resonant frequency of the rock/shale formation. When the duty cycle is tuned for a specific rock or rock or earth formation species, it is designed to achieve a coupled shock amplification that greatly magnifies the fracturing and/or shearing mechanisms at a wave amplitude and frequency causing catastrophic fractures that propagate with pronounced effect.

The ability to program the pressure amplitude and frequency of the pneumatic pulses emanating from the pneumatic fracturing tool 54 makes the pneumatic fracturing system 50 flexible and versatile. For example, the user can program the pneumatic fracturing tool 54 with a duty cycle for extremely soft rock formations, extremely hard rock formations, and all formations in-between or other types of earth formations.

It should also be appreciated that the pneumatic fracturing tool 54 can be configured not to pulse. For example, the pneumatic fracturing tool 54 can be configured to provide a static amount of pressure (or approximately static amount of pressure) for the duration of the fracturing operation. The pneumatic fracturing tool 54 can also be configured to provide gas pressure that increases, peaks, and then decreases—i.e., a single pulse of a given duration and type of amplitude or varying amplitude as desired.

It should be appreciated that numerous changes and variations can be made to the control station 52. For example, the control station 52 can be configured to communicate with the pneumatic fracturing tool 54 in a variety of ways including over fiber optic cable. The tool control system 56 can be preprogrammed with a given duty cycle prior to the pneumatic fracturing tool 54 being delivered to the drill site. For example, the pneumatic fracturing tool 54 can be preprogrammed at the factory.

In some embodiments, the tool control system 56 can connect directly to a network such as the Internet from which the duty cycle can be downloaded. The tool control system 56 can connect to the Internet wirelessly or by way of a cable. A monitor, keyboard, mouse, or other input device can be connected to the tool control system 56 to program it with the desired duty cycle.

It should be appreciated that the pneumatic fracturing system 50 can be viewed as having an overall control system that includes all of the components, modules, and the like that control and/or monitor the operation of the system 50. The components can be part of the control station 52, the pneumatic fracturing tool 54, or other devices. For example, the control system for the pneumatic fracturing system 50 shown in FIG. 1 can include the control station 52 and the tool control system 56.

Pneumatic Fracturing Tool

Figure 2:
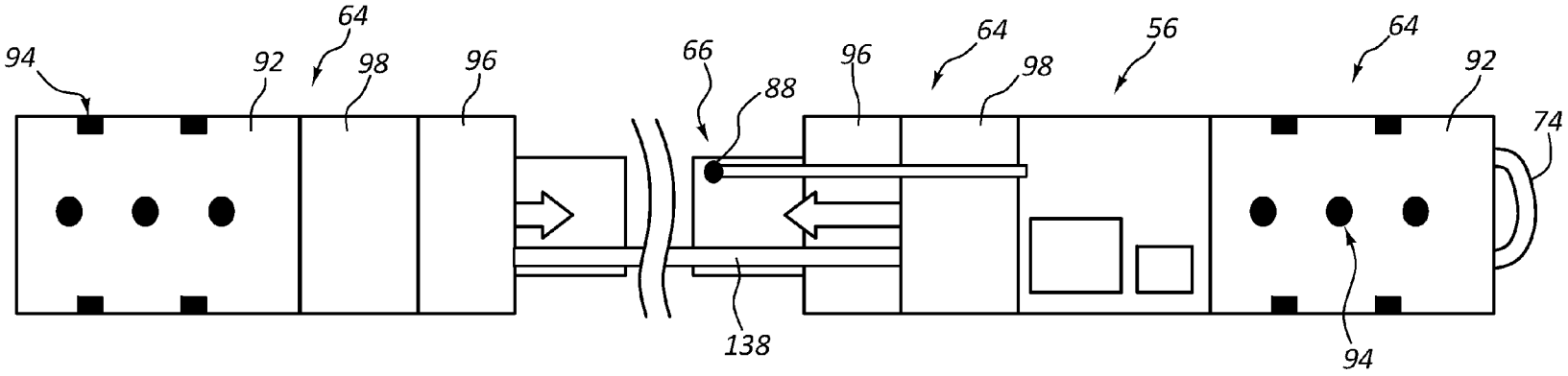
FIG. 2 is a conceptual drawing of one embodiment of a pneumatic fracturing tool.

Referring to FIGS. 1-2, the pneumatic fracturing tool 54 includes the tool control system 56 (alternatively referred to as a control assembly), a housing assembly 62 (alternatively a tool body), a gas jet deployment assembly 64 (alternatively referred to as a gas jet section, a shearing assembly or shearing device), and a gas generation assembly 66 (alternatively referred to as a gas generation chamber, propellant assembly, propellant chamber, fuel assembly, or fuel chamber). In the embodiment shown in FIGS. 2-4, the pneumatic fracturing tool 54 includes a single gas generation assembly 66 positioned between two gas jet deployment assemblies 64 (alternatively first and section sections of the tool body). It should be appreciated, however, that the pneumatic fracturing tool 54 can include any number and configuration of any of these components.

The pneumatic fracturing tool 54 is configured to burn a propellant to generate high pressure gas that is used to fracture or disrupt the adjacent geological rock formation. The gas is ducted internally within the pneumatic fracturing tool 54 and modulated for pressure pulsing at amplitudes and frequencies that are in harmony with the resonant frequency of the rock. The high pressure pulses are jetted from the pneumatic fracturing tool 54 in alignment with perforations in the well bore casing. The pulses travel through the perforations of the casing and disperse in the formation creating fractures that increase the permeability of the rock and increase production of trapped resources.

Housing Assembly

The housing assembly 62 includes those components that enclose and protect the internal components that generate and direct the high pressure gas into the rock formation. In the embodiment shown in FIGS. 1 and 3, the housing assembly 62 includes an outer housing 68 (alternatively referred to as an outer sheath or shroud), roller assemblies 70, access ports 72 (alternatively referred to as access hatches), and a coupler 74.

Figure 3:
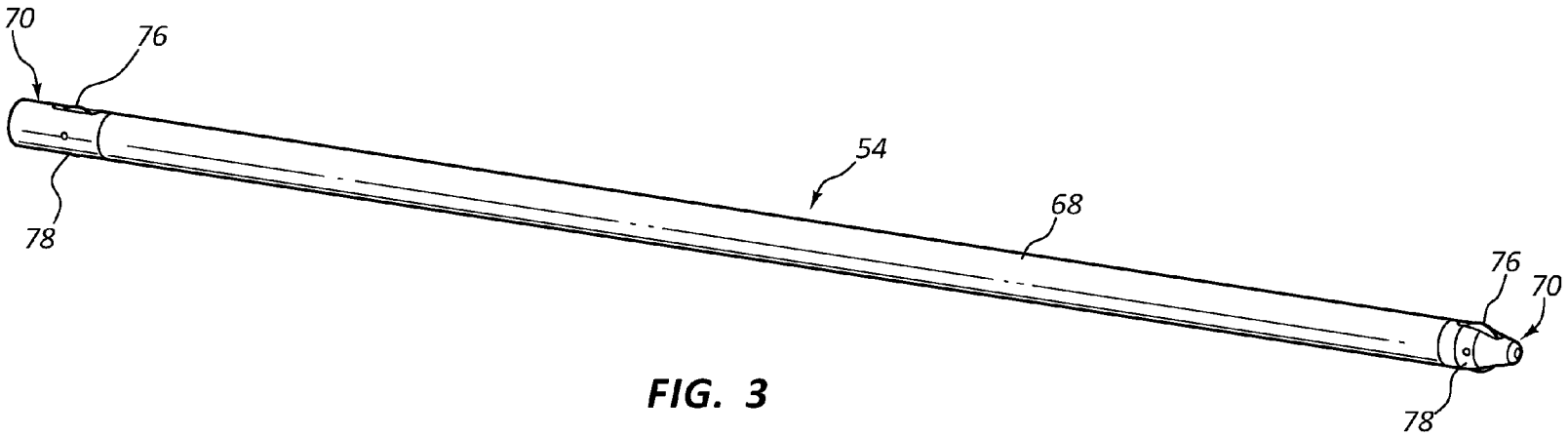
FIG. 3 is a perspective view of another embodiment of a pneumatic fracturing tool in a fully assembled condition.

Referring to FIG. 3, the housing 68 is coupled to roller assemblies 70 positioned at opposite ends of the pneumatic fracturing tool 54. The housing 68 encloses and protects the internal components including potentially sensitive electronic equipment from the extreme down hole environmental conditions including high pneumatic and hydraulic pressures and high temperatures.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The housing 68 can have any suitable shape and size. In one embodiment, the housing 68 has an elongated tubular shape. The housing 68 can be cylindrical, square tubular shape, or other suitable shape. In general, the housing 68 is shaped to at least roughly correspond to the shape of the drill hole and/or the internal components of the pneumatic fracturing tool 54. In one embodiment, the housing is circular or cylindrical because such a shape is stronger and better able to hold the high pressure gases generated by process.

The housing 68 can be made of any suitable material that is capable of protecting the internal components of the pneumatic fracturing tool 54. Suitable materials include metal, plastics, and composites. In one embodiment, the housing 68 is made of high strength steel that is capable of protecting the internal components from the high temperatures and pressures (pneumatic and/or hydraulic) present in the drill hole. In another embodiment, the housing 68 can be insulated from the hot gas using material such as rubber, carbon phenolic, silica phenolic, paper phenolic, fiberglass, and the like.

The roller assemblies 70 are positioned at each end of the pneumatic fracturing tool 54 to assist in its deployment and movement through the drill hole. Referring to FIG. 2, the roller assemblies 70 each include a roller 76 coupled to and extending through both sides of a roller housing 78. The roller housing 78 at the front of the pneumatic fracturing tool 54 is pointed (such as conical or frusto-conical for example) to help guide the pneumatic fracturing tool 54 through the drill hole.

It should be appreciated that the housing assembly 62 can be configured without the roller assemblies 70 or can use other techniques to make the pneumatic fracturing tool 54 easy to deploy. For example, the housing assembly 62 can have a slightly oblong shape to aid in moving the housing assembly 62 through the well bore or well casing.

The access ports 72 are openings in the housing 68 that provide ready access to the internal components. The access ports 72 can be configured to be repeatedly opened and closed as desired. The access ports 72 can be used for a variety of purposes, including to provide access to: (1) a communications port through which data can be transferred to and from the tool control system 56, (2) a power connector used to, for example, charge a battery, and (3) an internal battery so it can be replaced or serviced.

The coupler 74 is provided to facilitate the deployment and retrieval of the pneumatic fracturing tool 54. The coupler 74 is configured to be coupled to a wire, tube or other structure used to move and position the pneumatic fracturing tool 54 in the drill hole. The coupler 74 can have any suitable shape or configuration including a loop as shown in FIG. 2, hook, or the like.

The housing assembly 62 can be any suitable size. There are two main factors that come into play when sizing the housing assembly 62. First, it should be capable of traveling through the drill hole to the location that is desired to be fractured. Typically, the drill hole is cased with pipe casing so the housing assembly 62 should be capable of traveling through the pipe casing.

Second, the housing assembly 62 should be large enough to hold the amount of propellant and provide the desired mass flow needed to effectively fracture the rock. The size of the housing assembly 62 can be adjusted (length and/or width) depending on the application and the characteristics of the rock species.

In one embodiment, the housing assembly 62 is sized to pass through drill hole pipe casings that have an outer diameter of approximately 3.5 inches to approximately 9 inches or approximately 4 inches to approximately 4.5 inches. It should be appreciated that the housing assembly 62 can also be sized to pass through drill hole pipe casings that are larger than approximately 9 inches.

The housing assembly 62 can also have any suitable length that allows it to travel through the corresponding hole casing. In one embodiment, the housing assembly 62 is approximately 6 feet to approximately 30 feet in length, approximately 8 feet to approximately 15 feet in length, or any range in between either of these recited ranges.

In one embodiment, the housing assembly 62 includes a cylindrical housing 68 having an outer diameter of approximately 2.25 inches to approximately 12 inches, approximately 3 inches to 4 inches, or any range in between either of these ranges. The housing assembly 62 is also approximately 9 feet to approximately 13 feet in length. It should be appreciated that all of these dimensions given for the housing assembly 62 also apply to the pneumatic fracturing tool 54 by virtue of the fact that the housing assembly 62 represents the outer dimensions of the pneumatic fracturing tool 54.

Numerous changes can be made to the size and shape of the housing assembly 62. For example, in one embodiment, the internal components of the pneumatic fracturing tool 54 can have a standard size and configuration that can be used with any size and configuration of the housing assembly 62. In some embodiments, this makes the pneumatic fracturing tool 54 versatile in that it can be used in connection with a wide variety of drill hole sizes just by changing the size and shape of the housing assembly 62.

Gas Generation Assembly

The gas generation assembly 66 includes a gas generation housing 80, propellant or propellant container 82 (alternatively referred to as energetics or fuel), insulation 84, igniter 86, and sensors 88. The gas generation assembly 66 is where gas is generated in the pneumatic fracturing tool 54. The gas is generated by combustion of the propellant 82.

The gas generation housing 80 forms at least a portion of a gas generation chamber 90 where the combustion takes occurs. In the embodiment shown in FIGS. 3-4, the gas deployment assemblies 64 are coupled to opposite ends of the gas generation housing 80 to form the gas generation chamber 90.

The gas generation chamber 90 should be capable of withstanding high temperatures and high pressures. In one embodiment, the gas generation chamber 90 is capable of withstanding pressures of approximately 2,000 psia to approximately 20,000 psia, approximately 3,000 psia to approximately 18,000 psia, or any range within either of these ranges. On the low end in some embodiments, the gas generation chamber 90 can be configured to hold pressures of at least approximately 2,000 psia, at least approximately 2,500 psia, or at least approximately 3,000 psia. On the high end in such an embodiment or others, the gas generation chamber 90 can be configured to hold pressures of at least approximately 7,000 psia, at least approximately 10,000 psia, at least approximately 12,000 psia, or at least approximately 15,000 psia.

In some embodiments, the gas generation chamber 90 is capable of withstanding temperatures of at least approximately 1,000° F., at least approximately 1,500° F., at least approximately 2,000° F., at least approximately 2,500° F., at least approximately 3,000° F., at least approximately 4,000° F., at least approximately 5,000° F., at least approximately 5,500° F., or at least approximately 6,000° F. Likewise, the components that form the gas generation chamber 90, such as the gas generation housing 80 and the gas deployment assemblies 64 can be capable of holding the same pressures and withstanding the same temperatures.

The gas generation housing 80 and any other components that form the gas generation chamber 90 can be made of any suitable material capable of withstanding the high temperatures and pressures associated with generating the pressurized gas. In one embodiment, these components can be made of steel, aluminum, titanium, and/or other high strength refractory metallic materials.

The insulation 84 is provided to help prevent the high temperatures encountered in the drill hole from auto-igniting the propellant or propellant container 82. The insulation 84 can be any suitable insulating material. In one embodiment, the insulation is positioned on the inside of the gas generation housing 80 between the propellant 82 and the gas generation housing 80.

The igniter 86 is used to ignite the propellant 82 and commence gas generation. The igniter 86 can be any suitable device that is capable of igniting the propellant 82. The sensors 88 are used to monitor conditions inside the gas generation chamber 90 such as temperature and pressure. The sensors 88 can include any suitable sensors such as temperature and pressure sensors (e.g., temperature and pressure transducers).

The propellant 82 burns in the gas generation chamber 90 to provide the high pressure gas used to fracture the surrounding rock formation. The propellant 82 can be any suitable material and/or have any size and shape configuration. In one embodiment, the propellant 82 includes solid rocket propellant.

In one embodiment, the propellant 82 has one or more of the following characteristics. The burn rate is approximately 0.01 in/sec to approximately 1.0 in/sec at 1,000 psia or any range within that range. The burn rate sensitivity to pressure or burn slope is approximately 0.2 to approximately 0.9 or any range with that range. The density is approximately 0.05 $lbm/in^3$ to approximately 0.067 $lbm/in^3$ or any range within that range. The propellant 82 is also resistant to high soak temperatures encountered in drill holes. For example, the propellant 82 can operate at soak temperatures of least 200° F. or at least 250° F.

In one embodiment, the propellant 82 is solid and includes ammonium perchlorate. For example the propellant 82 can be a standard ammonium perchlorate formulation that is typically used in tactical missile applications and on missile boosters. Ammonium perchlorate propellants are robust and can withstand the high soak temperatures typical of down hole use including the temperatures mentioned in the previous paragraph.

In another embodiment, the propellant 82 can include a double base formulation that uses a variant of nitro glycerin explosives (RDX, and the like) and propellant plasticizers. These formulations are typically easier to manufacture than ammonium perchlorate formulations, and in some embodiments they do not contain ammonium perchlorate which is a potential ground water pollutant.

In another embodiment, the propellant 82 can include ammonium nitrate. Ammonium nitrate formations are clean burning and controllable due to the inherent characteristic of high burn rate sensitivity to operating chamber pressure. Some embodiments of these formulations are especially useful for fracturing when a high internal pressure throttling is beneficial.

The propellant 82 can be a propellant grain. The term "grain" is a term used in connection with rocket motors to generically refer to the solid propellant energetic material that is cast and/or pressed into its final geometry. The propellant 82 can be cast or pressed into any suitable geometry.

Figure 4:
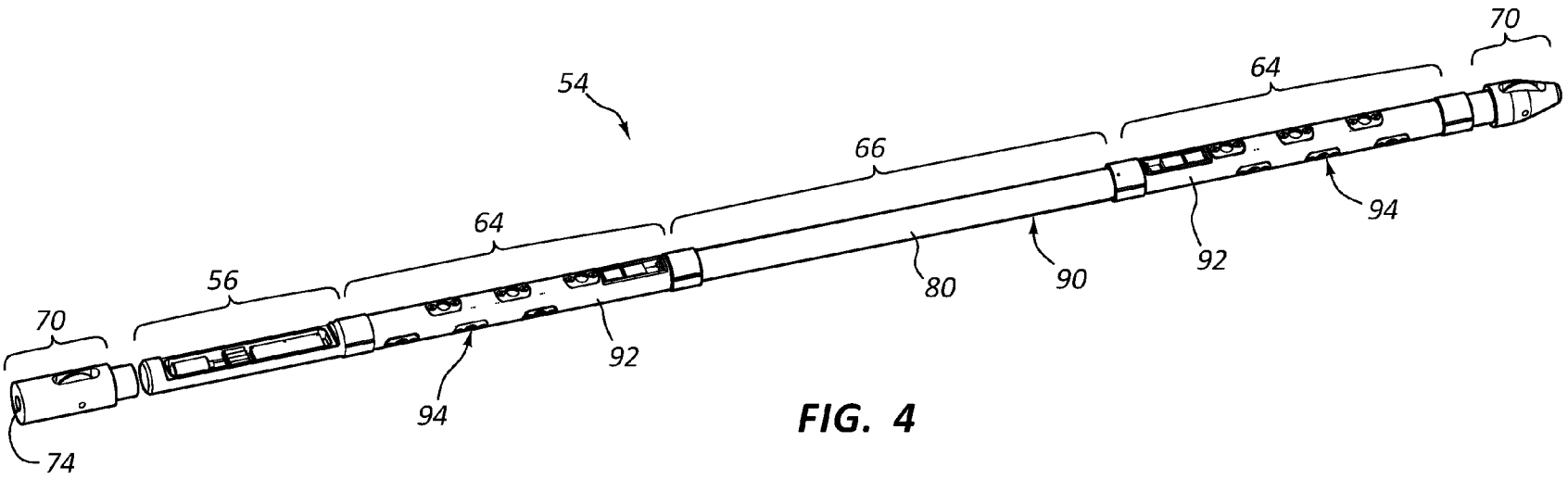
FIG. 4 is a perspective view of the pneumatic fracturing tool in FIG. 3 with the outer housing removed.

In the embodiment shown in FIGS. 2-4, the gas generation assembly 66 supplies gas to the gas deployment assemblies 64 coupled to opposite ends of the gas generation assembly 66. In this configuration, the propellant 82 can be configured to provide roughly equal gas flow rates and pressures to each gas deployment assembly 64.

Figure 5:
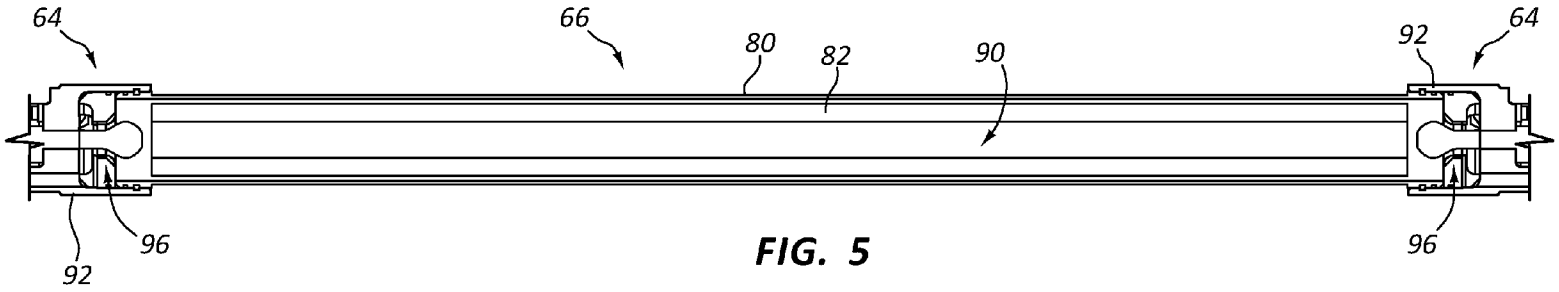
FIG. 5 is a cross-sectional view of one embodiment of a gas generation assembly that can be included as part of the pneumatic fracturing tool in FIG. 3.

In one embodiment, the propellant 82 is a center perforated solid propellant grain such as that shown in FIG. 5. The term "center perforated" is another term used in connection with rocket motors to effectively mean that there is a hole down the middle of the propellant grain that allows gas to flow to either gas generation assembly 66.

It should be appreciated that the grain size, geometry, length and ballistic burn back profile of the propellant 82 can be varied in any desired manner. For example, it may be desirable to alter the gas flow rate and/or operating time of the gas generation assembly 66. This can be accomplished by making the propellant 82 a single continuous grain module or a series of smaller grain sections "daisy chained" together. The position of the gas generation assembly 66 between the gas deployment assemblies 64 makes changing the size and/or length of the propellant 82 a relatively simple matter.

The size of the gas generation housing 80, particularly the diameter for those embodiments that are round, is proportional to the energy output capability of the pneumatic fracturing tool 54. In general, a larger gas generation housing 80 allows more propellant 82 to be included in the gas generation assembly 66, which increases the stored propellant energy and potentially burn duration and number of output duty cycles.

As mentioned above, the propellant 82 can be a center perforated grain that burns from the inside outward. The diameter of the propellant 82 increases the propellant burn distance, called propellant web, and therefore is proportional to the burn time, at a given operating pressure, and attendant duty cycles of pressure pulsing. Thus, a larger propellant 82 allows more pulses, which causes a greater degree of catastrophic fracturing resulting in improved permeability of the rock formation.

Figure 6:
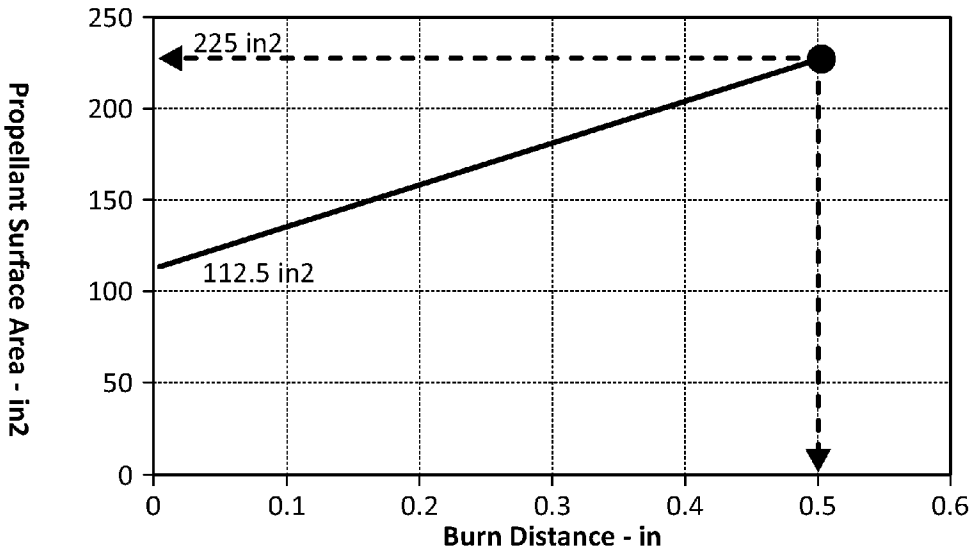
FIG. 6 is a chart showing the relationship between the propellant surface area and burn distance for a center perforated propellant grain.

FIG. 6 shows the burn back characteristics of one embodiment of a center perforated propellant grain. It shows that as the propellant 82 burns, the burn surface area increases. This increase in propellant burn are with propellant web is called a progressive burning propellant grain. In other words, as the propellant 82 burns, the size of the hole running through the center gets bigger, which increases the burn surface area. The gas mass flow rate is proportional to the burn surface area (at constant chamber pressure) so the longer the propellant 82 burns, the greater the gas mass flow rate through the gas deployment assembly 64 with each pressure pulse. The increased mass flow rate is beneficial to the operation of the pneumatic fracturing tool 54 because the additional gas can be used to further penetrate and fracture the continually expanding fracture volume of the rock formation.

In one embodiment, the propellant 82 used in the pneumatic fracturing tool 54 can have the following physical characteristics: (1) propellant weight of approximately 5 lb., (2) propellant grain diameter of approximately 2.0 inches, and (3) the propellant inner bore diameter of approximately 1.0 inches. The propellant 82 can also satisfy the following requirements: (1) operating pressure of up to at least 15,000 psia, (2) burn rate of approximately 0.5 in/sec at 1,000 psia, (3) burn slope of approximately 0.2, (4) density of approximately 0.06 $lbm/in^3$, (5) cstar of approximately 4843 ft/sec, and (6) a flame temperature of approximately 4,290° F.

In another embodiment, the propellant 82 used in the pneumatic fracturing tool 54 can have the following physical characteristics: (1) propellant weight of approximately 5 lb., (2) propellant grain diameter of approximately 2.0 inches, and (3) the propellant inner bore diameter of approximately 1.0 inches. The propellant 82 can also satisfy the following requirements: (1) operating pressure of up to at least 15,000 psia, (2) burn rate of approximately 0.39 in/sec at 1,000 psia, (3) burn slope of approximately 0.023 up to 2,500 psia; burn slope of approximately 0.003 from 2,500 psia to 9,500 psia; burn slope of approximately 0.00021 from 9,500 psia to 15,000 psia, (4) density of approximately 0.062 lbm/in$^3$, and (5) cstar of approximately 5022 ft/sec.

Gas Deployment Assembly

Referring to FIGS. 1, 4, and 7-10, the gas deployment assemblies 64 each includes a gas deployment housing 92, nozzle assemblies 94 (alternatively gas jet openings), valve assemblies 96 (gas jet valves), an actuator 98, and sensors 100. The gas deployment assemblies 64 are configured to deliver the high pressure, hot gas from the gas generation assembly 66 through the nozzle assemblies 94 and into the inner well bore to initiate formation fracturing.

The gas deployment housings 92 hold the various components of the gas deployment assemblies 64 and duct the high pressure gas from the valve assemblies 96 to the nozzle assemblies 94. The gas deployment housings 92 are coupled to the gas generation housing 80 with the valve assemblies 96 positioned in-between. The gas deployment housings 92 can be coupled to the gas generation housing 80 using any suitable joining method. In one embodiment, the gas deployment housings 92 are coupled to the gas generation housing 80 by way of a lock wire joint, threaded joint, bolted joint, castle nut joint, or the like.

The gas deployment housing 92 can be similar in many ways to the gas generation housing 80 including the pressures and temperatures it can withstand and the materials it can be made of. In one embodiment, the gas deployment housing 92 is metallic and is machined and/or casted from the materials described in connection with the gas generation housing 80.

Valve Assemblies

Figure 8:
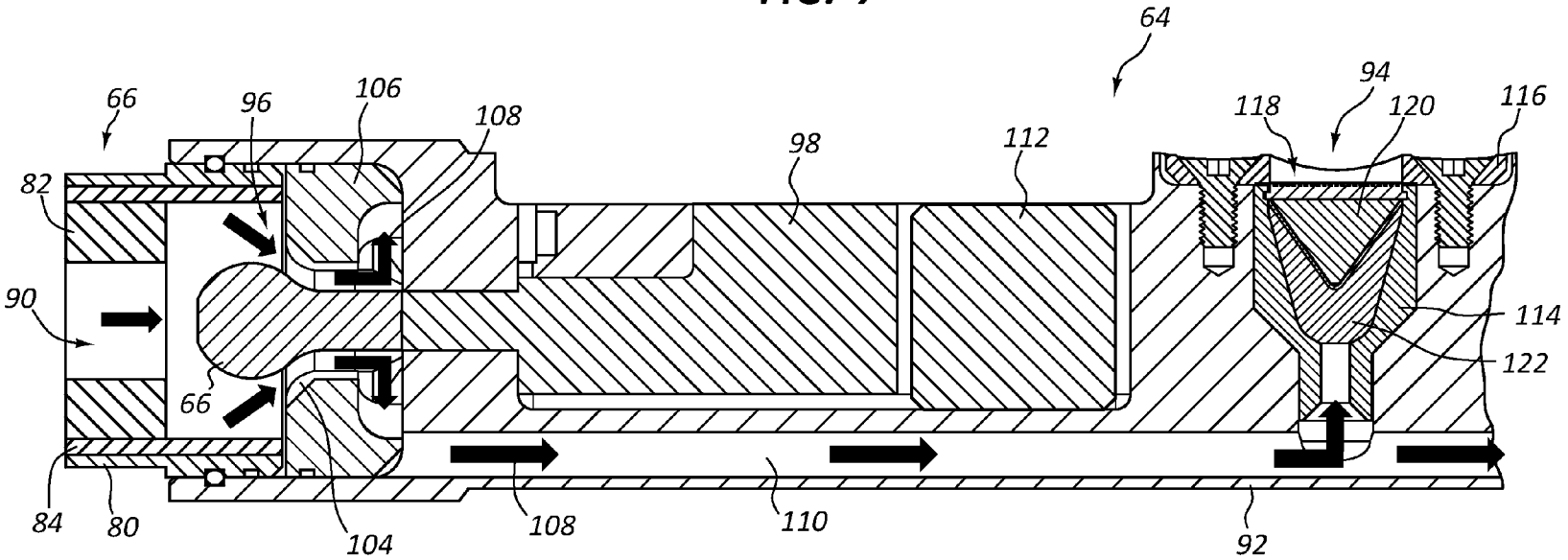
FIG. 8 is a cross-sectional view of one embodiment of a valve assembly included as part of the gas deployment assembly in FIG. 7.

Referring to FIG. 8, the valve assemblies 96 each include a valve 102 (alternatively referred to as a hot gas valve), throat 104, and throat support 106. The valve assembly 96 is shown in the open position in FIG. 8. The high pressure gas 108 flows from the valve assemblies 96, through a channel or passageway 110 in the gas deployment housing 92 and on to the nozzle assemblies 94.

In one embodiment, the valves 102 can be repeatedly opened and closed during operation of the pneumatic fracturing tool 54 to provide the pressure pulses for the specific duty cycle. The valves 102 can be selectively opened and closed by the tool control system 56. In another embodiment, the valves 102 can be opened and remain open for the duration of the fracturing operation and then closed when it is finished. The former method is preferred for the reasons already given.

The valves 102 are actuated between the open position and the closed position by the actuator 98 and an actuator driver 112. The valves 102 can be actuated in a variety of ways. In one embodiment, the valves 102 are actuated linearly in the manner shown in FIG. 8. The valves 102 can move linearly in a direction that is at least substantially parallel to a longitudinal axis of the pneumatic fracturing tool 54 and the gas deployment housing 92.

The actuators 98 can be any suitable actuator capable of moving the valves 102 between the open position and the closed position. This could be challenging for many actuators due to the high pressures associated with the gas generation assembly 66. In one embodiment, the actuators 98 are electromechanical (EM) actuators that move the valves 102 linearly in the manner shown in FIG. 8. Electromechanical actuators are clean and easy to integrate, storable for long periods of time and robust during shipping and handling. Electromechanical actuators can easily meet the performance, environmental, and operating requirements of the pneumatic fracturing tool 54.

The actuator drivers 112 include the circuitry used to control the actuators 98. It should be appreciated that the actuators 98 and the actuator driver 112 can be combined into a single unit that controls movement of the valves 102.

In one embodiment, the actuator driver 112 can include high power, actuation driver circuitry with high power field effect transistor switching circuits and rotary commutation commanded circuitry along with position sensors. The position sensors are considered part of the sensors 100 and can include any suitable type of position sensor. In one embodiment, the position sensors can include linear potentiometers, linear voltage differential transducers (LVDT), and the like.

The actuation driver circuitry can include closed control loop circuits that provide the command proportionality. In other words, the tool control system 56 can provide a control signal to each of the actuators 98 to move the valves 102 to a given position and the respective actuation valve driver circuitry provides the high power to the electromechanical actuator motor to change the position of the valves 102.

In another embodiment, the actuators 98 can include hydraulic actuators. Such a system can include a high pressure hydraulic supply and a hydraulic pressure tank. The hydraulic fluid can be pressurized using the high pressure gases in the gas generation chamber 90 via a pressure passage to a hydraulic piston or bladder. Alternately the hydraulic pressure can be provided by a small high pressure gas cartridge similar to a commercially available paint gun cartridge.

The hydraulic actuator can also use a servo valve that supplies high pressure hydraulic fluid, delivered from the hydraulic supply, to either side of the hydraulic piston. The servo valve can be controlled fast enough to proportionally control the piston position via raid sequencing of the high pressure hydraulic fluid on either side of the piston while ducting away residual fluid. The servo valve can sequence the hydraulic fluid to the piston channels via high speed internal solenoid valves.

The position of the hydraulic piston can be measured via a linear position sensor such as those described above. The position of the piston can be communicated to a hydraulic actuator electric control circuit that controls the position of the servo valve.

The hydraulic control electronics can be housed in a stand-alone electronics enclosure or combined with the other electronics included as part of the tool control system 56. Advantages of a hydraulic actuation system include: high force, high frequency response, and slew rate. Disadvantages of such a system include potential hydraulic fluid leakage during storage and increased complexity.

In another embodiment, the actuators 98 can include electric voice coil actuators. These actuators use electric voltage/current and Faraday's law to conduct high frequency positioning of the valves 102. These actuators are designed to be non-contract in a manner that is similar to a brushless electromagnetic motor but with a single coil. Electric voice coil actuators are simple and easy to package but are likely to have lower load limits than other types of actuators.

In another embodiment, the actuators 98 can include piezo electric actuators. These actuators use Piezo material that changes geometric shape/dimensions when subjected to an electric voltage/current. These actuation devices can precisely position the valves 102 and have a relatively high load carrying capability. These actuation devices can also have large electronic enclosures and very small strokes at high slew rates.

In another embodiment, the actuators 98 can include pneumatic actuators. These actuators are similar to hydraulic actuators except the working fluid is a high pressure pneumatic gas instead of a liquid. These actuators can use the high pressure gases directly from the gas generation chamber 90 as the working gas for actuation. Alternatively, the working gas can be provided in a large high pressure inert gas cylinder (e.g., nitrogen, helium, argon, and the like). The working gas may compress making it difficult to accurately control the position of the valves 102.

It should be appreciated that the valve assemblies 96 can have any suitable configuration so long as it is capable of effectively releasing gas pressure from the gas generation chamber 90 to the valve assemblies 94. Numerous changes can be envisioned to the design of the valve assemblies 96. In one embodiment, the valve assemblies 94 can be configured in the manner shown in U.S. Provisional Patent Application No. 62/046,686, titled "VH2," filed on 5 Sep. 2014 and U.S. Provisional Patent Application No. 62/058,813, titled "High Temperature, High Pressure Valve System," filed on 2 Oct. 2014.

Nozzle Assemblies

Figure 7:
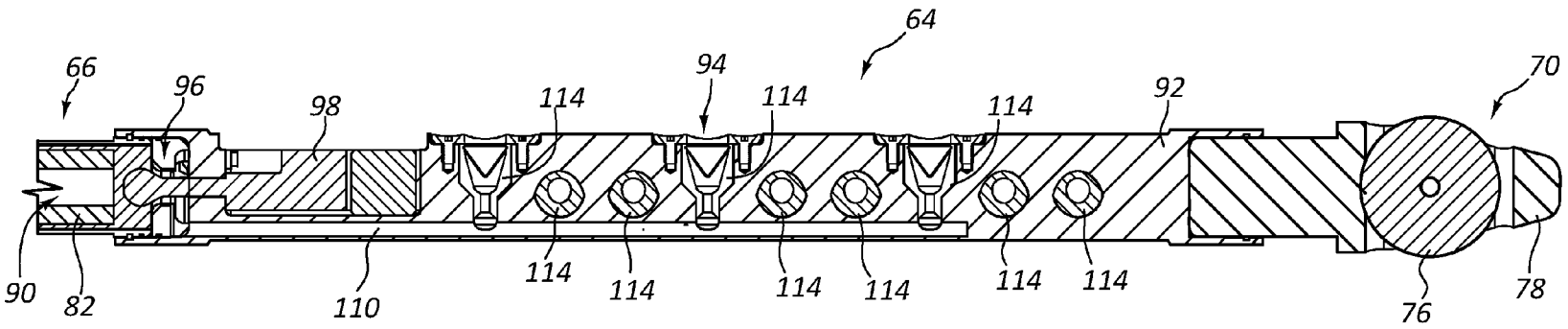
FIG. 7 is a cross-sectional view of one embodiment of a gas deployment assembly that can be included as part of the pneumatic fracturing tool in FIG. 3.
Figure 9:
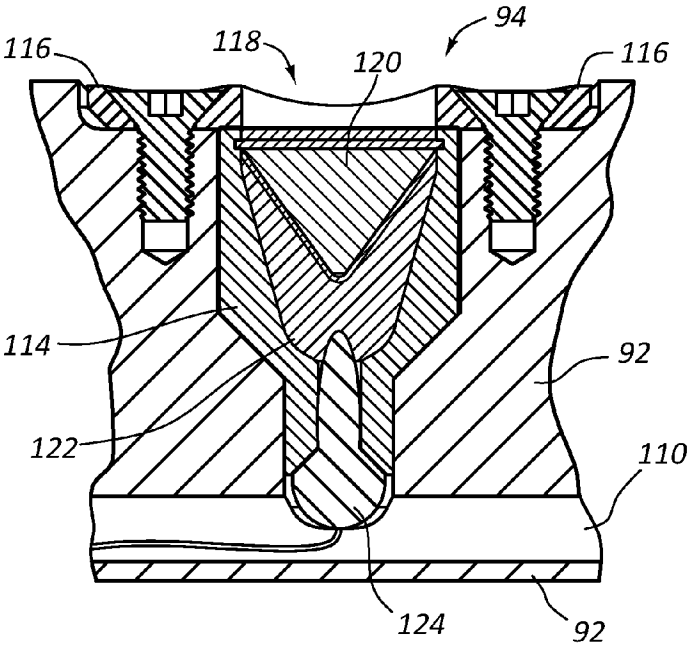
FIG. 9 is a cross-sectional view of one embodiment of a nozzle assembly included as part of the gas deployment assembly in FIG. 7.

Referring to FIGS. 7-9, the nozzle assemblies 94 each include a nozzle 114 and a nozzle retainer 116. The nozzles 114 are held in place in the gas deployment housing 92 by the nozzle retainers 116. It should be appreciated that in alternative embodiments, the nozzles 114 can be integrally formed as part of the gas deployment housing 92.

In one embodiment, the nozzle retainers 116 can also cover and seal the nozzles 114 to prevent moisture and/or debris from entering the nozzles 114 during shipping, handling, and the process of positioning the pneumatic fracturing tool 54 in the drill hole. The cover is broken by the high pressure gases as the fracturing process begins. Debris cannot enter through the nozzles 114 during operation because the internal pressures are higher than the external pressures in the well bore hole.

Figure 10:
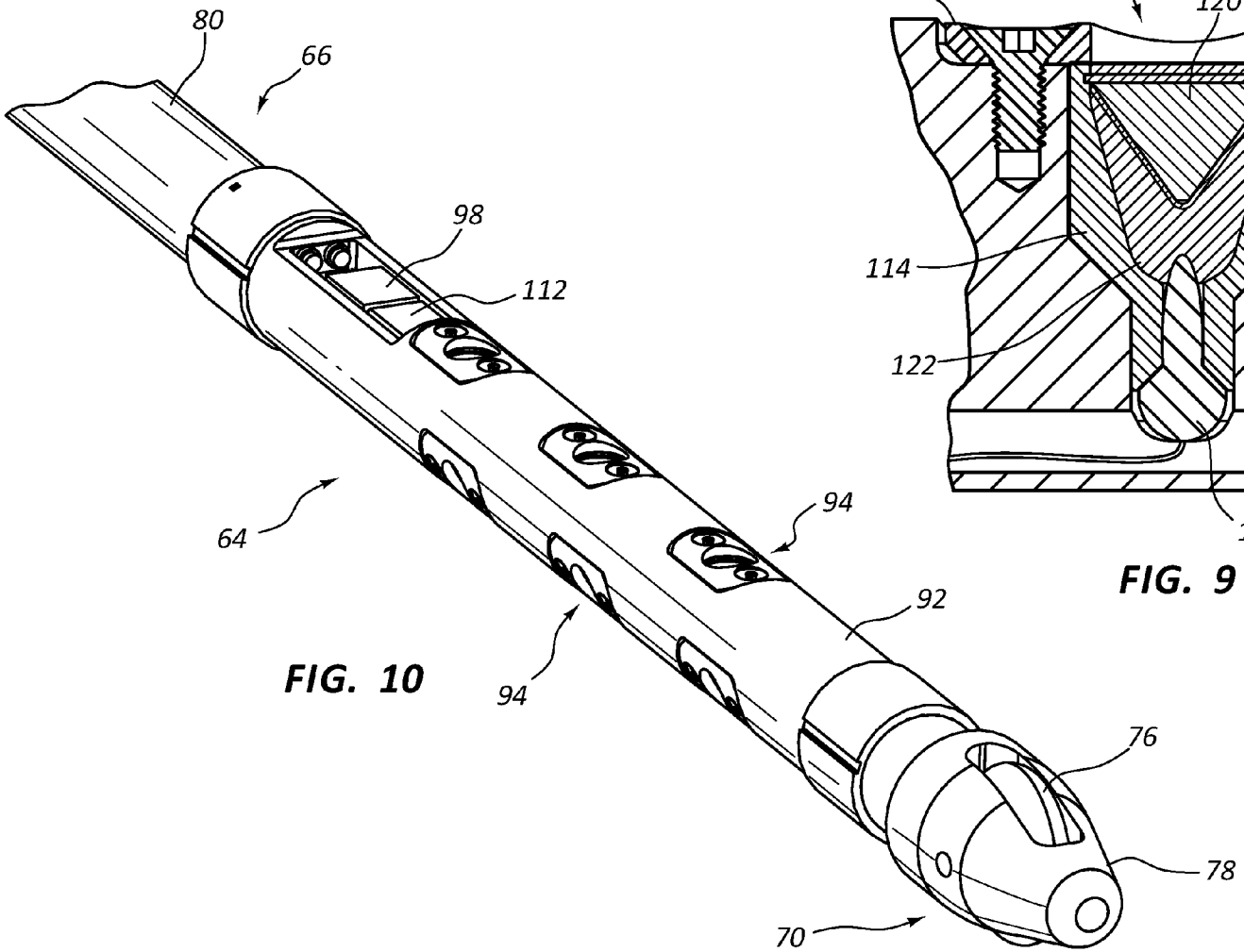
FIG. 10 is a perspective view of the gas deployment assembly in FIG. 7.

Referring to FIG. 10, each gas deployment assembly 64 includes a total of nine nozzle assemblies 94 divided into three groups of three. The three nozzle assemblies 94 in each group are aligned longitudinally along the outside of the gas deployment housing 92. The three groups are each offset longitudinally from the other groups (from about 10° to about 120° offset from each other) to prevent the internal ducting of the nozzle assemblies 94 from intersecting as shown in FIGS. 7 and 10.

It should be appreciated that the gas deployment assemblies 64 can include any number and configuration of nozzle assemblies 94. For example, the gas deployment assemblies 64 can each include at least two nozzle assemblies 94, at least three nozzle assemblies 94, or at least four nozzle assemblies 94. Also, the nozzle assemblies 94 can be positioned opposite each other on the gas deployment housing 92 with the gas nozzles in the opposed nozzle assemblies 94 facing 180° or approximately 180° away from each other.

Perforation Capability

Referring to FIGS. 8-9, the gas deployment assemblies 64 can include explosive charges 118 (alternatively referred to as perforation projectiles) that are used to perforate the well casing before beginning the fracturing process. Each explosive charge 118 includes a projectile 120, explosive material 122, and an initiator 124.

The explosive charges 118 can be any suitable type of explosive charge. In one embodiment, the explosive charges 118 are circular shaped charges. The projectile 120 can be any suitable material such as high density metallic material (e.g., copper, lead, depleted uranium, and the like). The explosive material 122 can be any suitable explosive such as C4 and the like. The initiator 124 can be detonation or blasting cord that is ignited by tool control system 56.

The explosive charges 118 can be used to create concentrically aligned perforation holes in the housing 68 and/or the well bore casing. The explosive charges 118 ensure that the holes in the housing 68 and/or the well bore casing are aligned with the nozzle assemblies 94. The effect of the pressure waves is not dampened by misalignment of the nozzle assemblies 94 relative to the well bore casing. This can provide a significant advantage in certain situations.

Perforating the housing 68 and/or the well bore casing with the explosive charges 118 can also enhance the effect of the pneumatic fracturing process. The explosive charges 118 impact the rock formation and create initial fractures that are enlarged during the subsequent fracturing process. Perforating the well bore casing in this manner can also create cost efficiencies because the well bore casing is perforated at the same time that the rock formation is fractured instead of in two separate procedures.

The pneumatic fracturing tool 54 can also be used with a well bore casing that is already perforated. In this instance, the existing perforations provide passageways to the rock formation so the explosive charges 118 may not be needed.

In one embodiment, the number, size, and/or position of the nozzle assemblies 94 can be selected to correspond to the preexisting perforations in the well bore casing. In this embodiment, the pneumatic fracturing tool 54 can be positioned so that the nozzle assemblies 94 are aligned with the perforations before the fracturing process begins.

In this embodiment, it is contemplated that the housing 68 also includes openings or perforations that correspond to the position of the nozzle assemblies 94. The openings can be covered or sealed until the pneumatic fracturing tool 54 is activated (the seals break open due to the gas pressure).

Tool Control System

Figure 12:
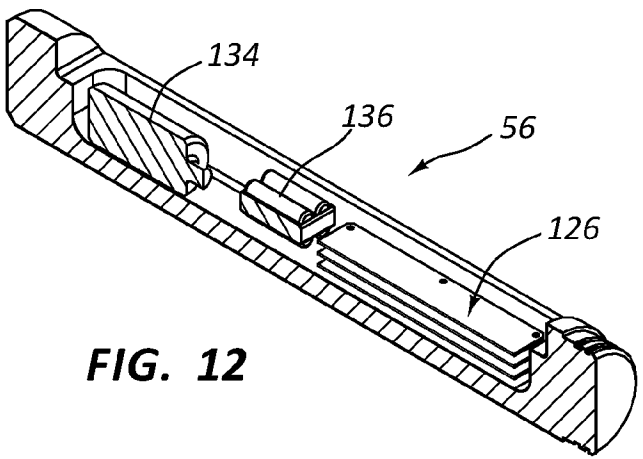
FIG. 12 is a cross-sectional perspective view of the tool control system in FIG. 11.
Figure 11:
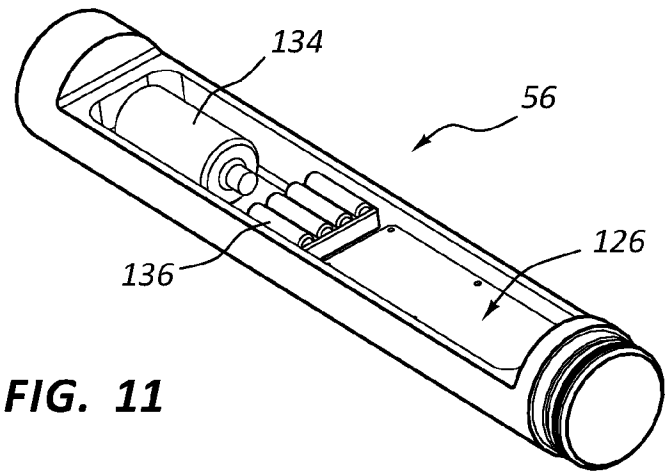
FIG. 11 is a perspective view of one embodiment of the components of a tool control system configured to control the pneumatic fracturing tool in FIG. 3.

Referring to FIGS. 1 and 11-12, the tool control system 56 includes a tool controller 126, sensors 128, batteries 130, and software 132. The tool controller 126 can include a computing device comprising an electronics board, processor, memory, storage, and the like. The computing device can have any of the same features and configuration as the computer 58—e.g., it can be a ruggedized special purpose computing device.

The tool controller 126 is generally used to control the various operations of the pneumatic fracturing tool 54 including initiating propellant ignition and the fracturing process, controlling the pressure pulses (amplitude and frequency), and logging all relevant data. In one embodiment, the sensors 128 provide data to the tool controller 126 to enable it to control and/or log various aspects of the fracturing process.

In one embodiment, the tool controller 126 can be eliminated or its functionality minimized and the pneumatic fracturing tool 54 can be controlled remotely by the computer 58 through a communication cable connected to the tool control system 56. The computer 58 performs all of the functions previously performed by the tool controller 126.

The batteries 130 include a high power battery 134 that supplies power to the actuators 98 and a low power battery 136 for low power electronics such as those included with the tool controller 126. It should be appreciated that the batteries 130 can modified in a variety of ways. For example, a single battery can be provided for the entire pneumatic fracturing tool 54 or more than two batteries can be provided for additional redundancy.

The batteries 130 can be any suitable batteries. In one embodiment, the high power battery 134 can be a thermal battery or a Lithium ion battery. In another embodiment, the low power battery 136 can be a 6-48 volt DC battery such as a 28 volt DC battery in the form of a replaceable battery pack.

Figure 13:
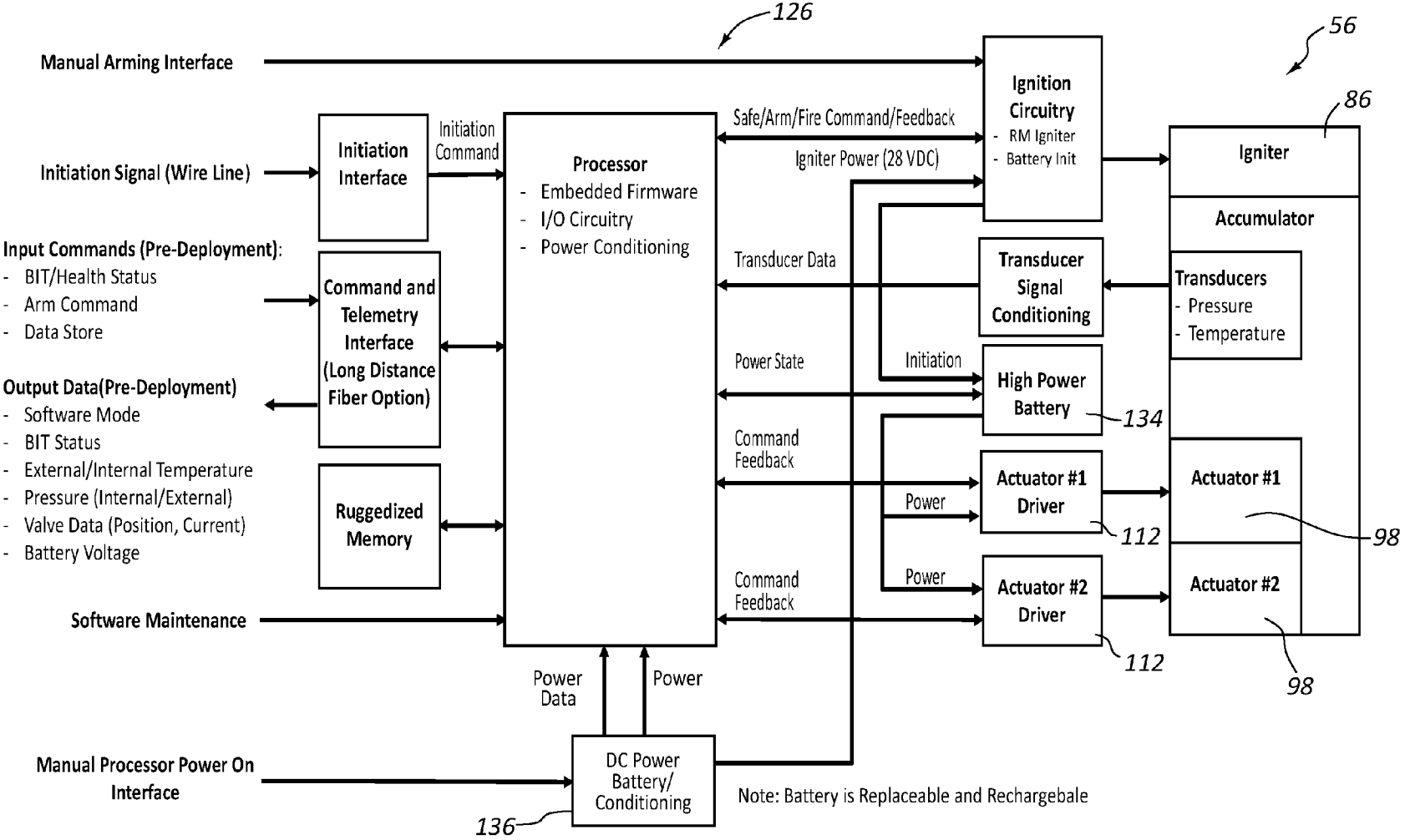
FIGS. 13-14 are diagrams of one different embodiments of the tool control system.
Figure 14:
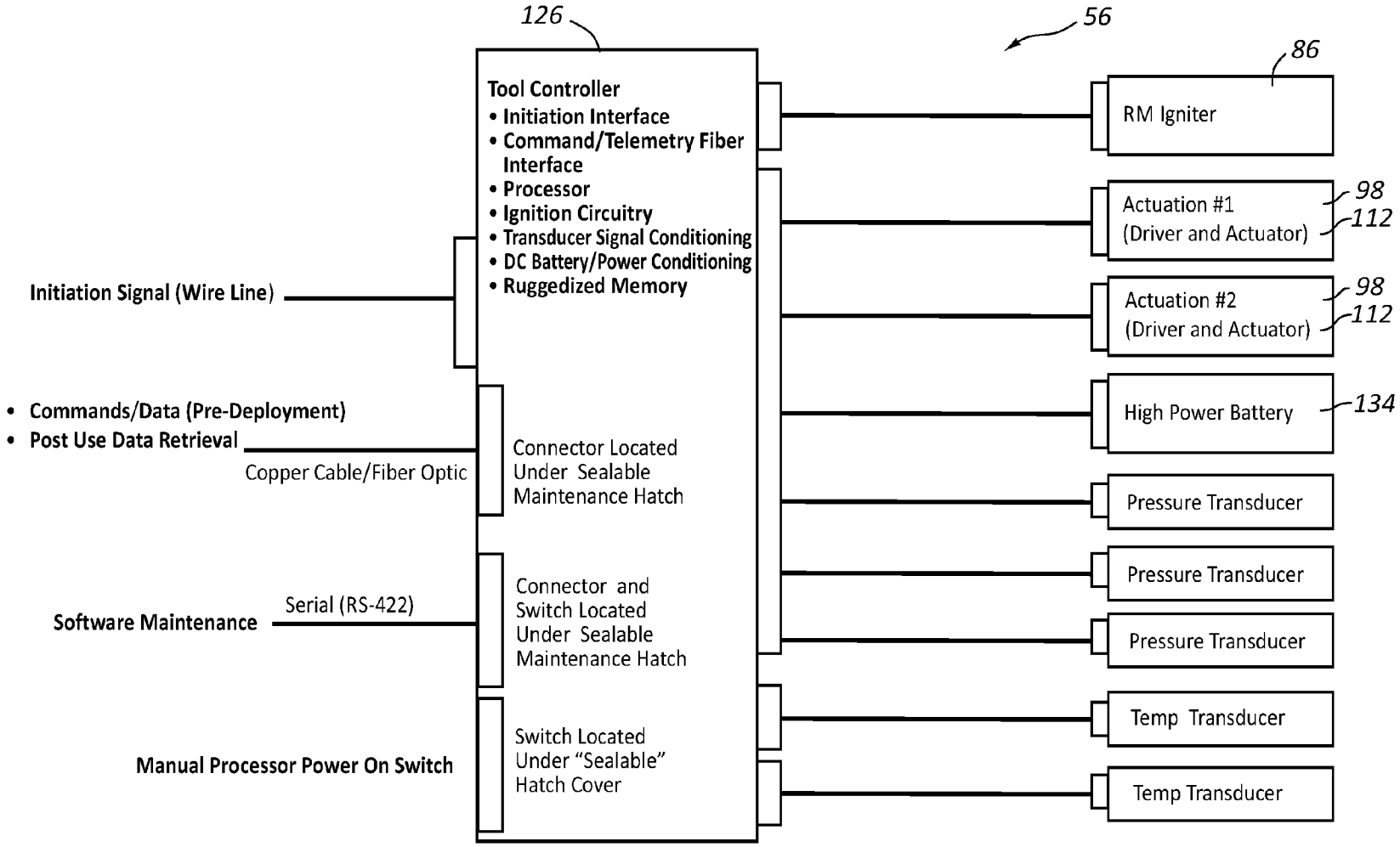

FIGS. 13-14 show detailed examples of one embodiment of the tool control system 56 and the tool controller 126. As shown in FIGS. 13-14, the tool controller 126 includes the I/O interfaces to receive the high voltage initiation signal to begin the fracturing process and to transmit and receive other data and signals. The tool controller 126 also includes interfaces to connect to the control station cable and to software maintenance components. The tool controller 126 is powered by the low power battery 136.

The tool controller 126 can send digital or analog commands to the various components of the pneumatic fracturing tool 54. In one embodiment, the tool controller 126 outputs analog commands and receives analog inputs to activate the actuators 98 using the high power battery 134. The tool controller 126 can also include safe/arm fire initiation circuitry for both the high power battery and the rocket motor ignition/igniter.

In this architecture, the tool control system 56 includes a communication bus or raceway 138 that is used to communicate information from the tool controller 126 across the gas generation assembly 66 to the far gas deployment assembly 64. The communication raceway is shown in FIG. 2. Alternatively, the communication raceway can be eliminated or made smaller by using two tool controllers 126. The tool controllers 126 are positioned on opposite sides of the gas generation assembly 66 and control the operation of the respective gas deployment assemblies 64. The tool controllers 126 can be synced together using a clock or timer (e.g., using a small cable that extends across a raceway).

The tool controller 126 can control the frequency and amplitude of the pressure pulses from the pneumatic fracturing tool 54. This can be accomplished through discrete control of a proportional linear positioned valves 102. The valves 102 can be controlled by the software 132 having specific algorithms that modulate the valves 102 and tune them to specific output performance characteristics necessary to achieve optimal fracturing effect.

In general, fracturing effects are optimized when the output frequencies of the pressure pulses are coupled with pedigree natural frequencies of the rock/shale formation. In this way, the pneumatic fracturing tool 54 exploits the physical sciences of mechanical mode amplification or mechanical resonance. Mechanical resonance is the tendency of a mechanical system to absorb more energy when the frequency of its oscillations matches the system's natural frequency of vibration than it does other frequencies. The pneumatic fracturing tool 54 intentionally excites mechanical resonance frequencies to match those of driving vibrational frequencies of the rock/shale, creating "resonance disaster."

In some cases the pressure pulsing can be biased or fluctuated along the length of the pneumatic fracturing tool 54 to thereby create a secondary coupling of shock waves within the rock formation (more energetic fracturing), or even a secondary waveform within the formation creating a residual pumping action as the wave form dissipates. These shear waves create a displacement effect within the fracture zones which enhances permeability passageways by wedging open the shear plane of the fractures.

Materials/Durability

It should be appreciated that the pneumatic fracturing tool 54 and its various components can be made of a variety of materials. In general, the pneumatic fracturing tool 54 and its components should be capable of satisfying a broad regime of temperature, pressure, and corrosive extremes. For example, the electronics included as part of the tool controller 126 should be capable of withstanding long periods of time at relatively high temperatures such as 250° F. and/or short periods of time at higher temperatures (e.g., 350° F. for 30 minutes). In one embodiment, the electronics can be protected with insulation and heat sinks. Alternatively, the electronics can be placed inside a vacuum flask to shield them from severe temperatures. Elastomeric seals should also be designed to withstand these conditions in temperature, pressure and the like.

The following is a list of materials that can be used to make the various components of the pneumatic fracturing tool 54. Metallic components can be made of 17-4 PH stainless steel, 300 series stainless steel, 4340 steel, Inconel 625/718, copper, aluminum 6061, and/or Haynes 188/230. Exotic refractories can be used in those areas of the pneumatic fracturing tool 54 that experiences high pressures, high temperatures, and high flow rates. Examples of suitable exotic refractories include molybdenumRhenium and/or ReMo (47.5% Rhenium-Molybdenum). Ablatives can be made of carbon phenolic—MX 4926, silica phenolic—FM 5504, garolite grade CE, and/or Kelvar filled EPDM. Elastomeric hot gas, high pressure seals can be made of Viton. It should be appreciated that this is not an exhaustive list and that other materials can be used as well.

Operation of the Pneumatic Fracturing System

Figure 15:
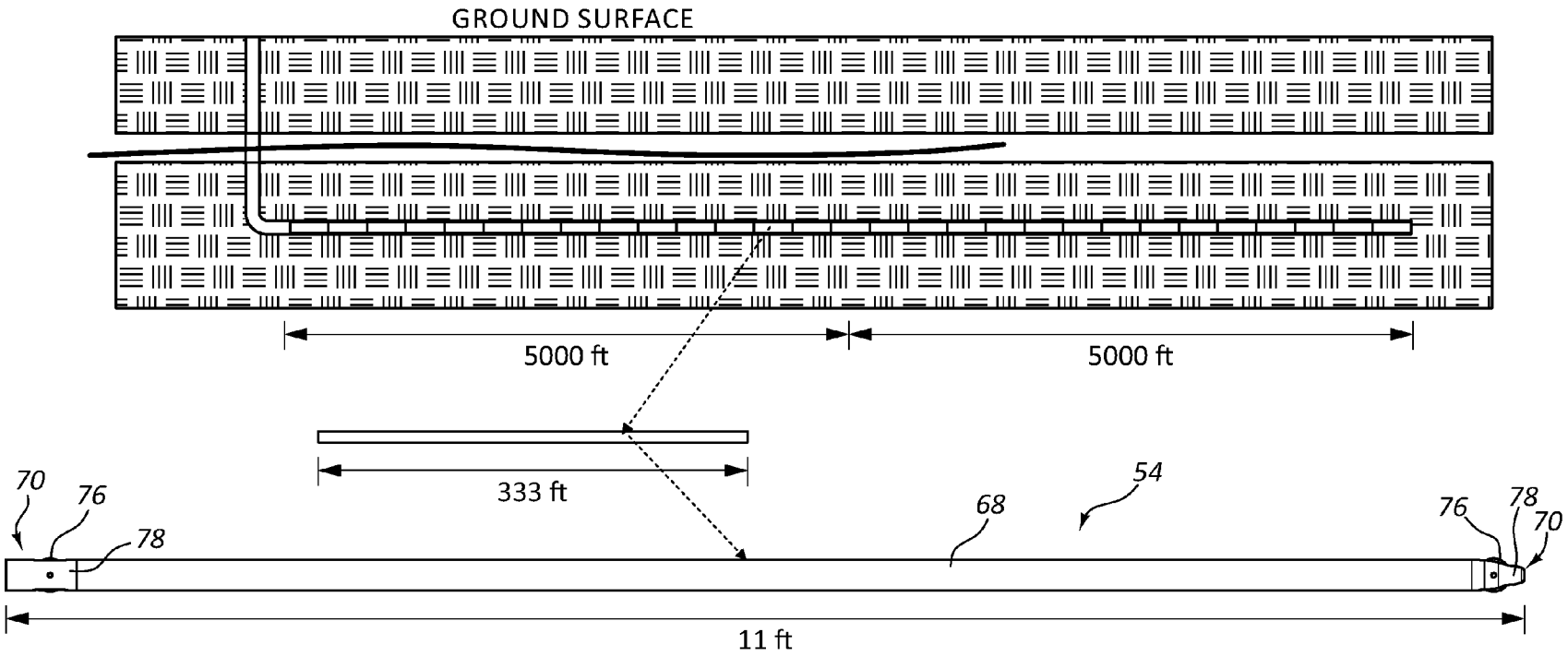
FIG. 15 shows one example of how the pneumatic fracturing system can be used in connection with a typical oil/gas well.

The pneumatic fracturing system 50 can be used in a variety of ways to fracture a variety of rock formations. FIG. 15 shows one example of using the pneumatic fracturing system 50 to fracture a rock formation that is typical of a well in North Dakota.

The pneumatic fracturing system 50 is used to enhance down hole fracturing to increase production yields for a single oil, gas, geothermal or water well. The following is a description of one embodiment of a procedure for fracturing a non-conventional oil/gas well that is typical of the Bakken formation in North Dakota. These wells typically have a vertical portion that extends down approximately 5000 feet to approximately 7000 feet followed by a horizontal portion that extends up to 10,000 feet into the formation.

A single pneumatic fracturing tool 54 can be positioned approximately every 300 feet in this type of well. The pneumatic fracturing tool 54 can fracture the rock formation along the entire 300 foot section. It should be appreciated that in other situations, a pneumatic fracturing tool 54 can be positioned every 50 feet to 1000 feet or within ranges of or between these numbers. The spacing of the pneumatic fracturing tools 54 depends on the size of the pneumatic fracturing tool 54, the characteristics of the rock formation, and the desired degree of fracturing.

The well is fractured beginning with the last section and moving to the closest section. Each section can be closed or "packed" off with well bore packers as part of the fracturing process. Packing the well bore helps force the gas pressure into the rock formation instead of escaping out the well bore. The decision whether to use packers can be made by the user depending on the characteristics of the formation and the desired objectives of the fracturing process.

In one embodiment, the data from the first few pneumatic fracturing tools 54 (in the first few sections) is analyzed and used to tune the duty cycles of the subsequent pneumatic fracturing tools 54. In this manner, the pneumatic fracturing tool 54 can variably sweep the pressure regimes of the rock and seek the optimal pressure pulse amplitude and frequency to disrupt the formation in the most productive manner.

In one embodiment, the data from only the first few pneumatic fracturing tools 54 is used to tune the duty cycles of all the subsequent pneumatic fracturing tools 54. In another embodiment, the data from one or more of the immediately preceding pneumatic fracturing tools 54 are used to tune the duty cycle of the next pneumatic fracturing tool 54.

The desired amplitude and frequency of the pressure pulse is initially programmed or selected using the computer 58 and loaded into the tool controller 126 of the pneumatic fracturing tool 54. The duty cycle can be transferred to the tool controller 126 wirelessly or via a cable. It should be appreciated that the duty cycle can be programmed and/or loaded into the tool controller 126 using any of the methods described elsewhere in this document.

The pneumatic fracturing tool 54 contains the duty cycle and is now ready to be lowered into the well bore. In one embodiment, the pneumatic fracturing tool 54 is pushed into the well bore with push tubing that contains and encloses a communication cable (also referred to as a wire line communication cable). The push tubing and wire line cable can be reeled from truck mounted cable reels.

The communication cable can be used to maintain constant communication with the pneumatic fracturing tool 54 during the process of lowing it to the desired well bore location. In one embodiment, the computer 58 can log data such as pressure, temperature, tool states, and the like as the pneumatic fracturing tool 54 is lowered into the well bore. This data can be used by geologists and other users to improve the output of the well.

Once the pneumatic fracturing tool 54 is in the correct position, it is ready to begin the fracturing operation. If the pneumatic fracturing tool 54 includes explosive devices 118, then they are initially detonated to perforate the housing 68 and/or the well bore casing. If the pneumatic fracturing tool 54 does not include explosive devices 118, then this step is skipped.

With the pneumatic fracturing tool 54 in place, the fracturing operation begins when an initiation signal is sent from the computer 58 over the communication cable to the tool controller 126. The initiation signal is configured to be unique and unable to be duplicated in nature to prevent accidental initiation (i.e. high frequency, high voltage command).

After receiving the initiation signal, the pneumatic fracturing tool 54 begins the fracturing process by activating the high power battery 134. In one embodiment, the high power battery 134 is a thermal battery that is activated by breaking a liquid chemical barrier that starts a chemical reaction that produces a substantial amount of electricity for a short period of time.

The amount of time to activate the high power battery 134 is approximately 1 second. The tool controller 126 monitors the voltage. When the proper voltage is achieved, the tool controller 126 ignites the propellant 82 with the igniter 86.

In one embodiment, the igniter 86 includes solid rocket propellant ignition technology that uses commercially available ignition squibs followed by a series of "ignition" energetic materials that collectively provide the appropriate hot gas and duration to ignite the main solid propellant grain. The tool controller 126 closes the valve assemblies 96 to assist the propellant ignition event. With the valve assemblies 96 closed, no gas can exit the gas generation chamber 90. The result is a very robust and repeatable ignition process.

The tool controller 126 monitors the pressure rise in the gas generation chamber 90 as the propellant 82 ignites and opens the valves 102 when the gas generation chamber 90 reaches a certain pressure. The duty cycle loaded into the tool controller 126 prior to deployment determines the pressure and rate at which the valves 102 are opened.

Figure 16:
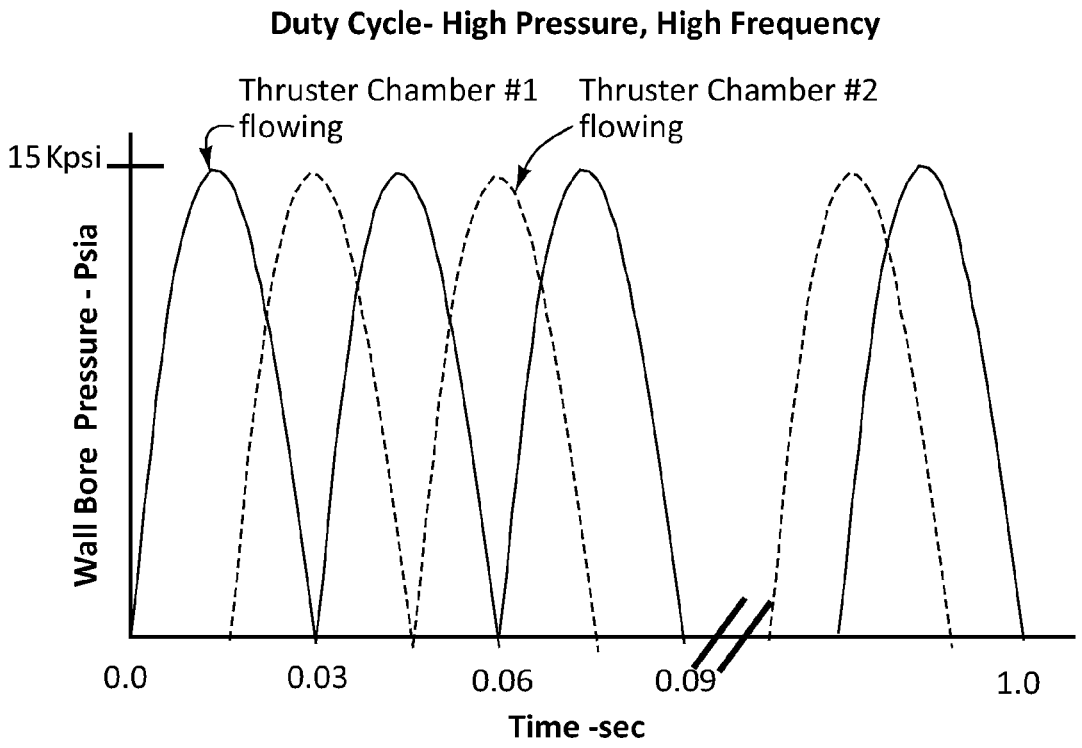
FIG. 16 is a chart of a relatively high pressure, high frequency duty cycle for the pneumatic fracturing tool—
Figure 17:
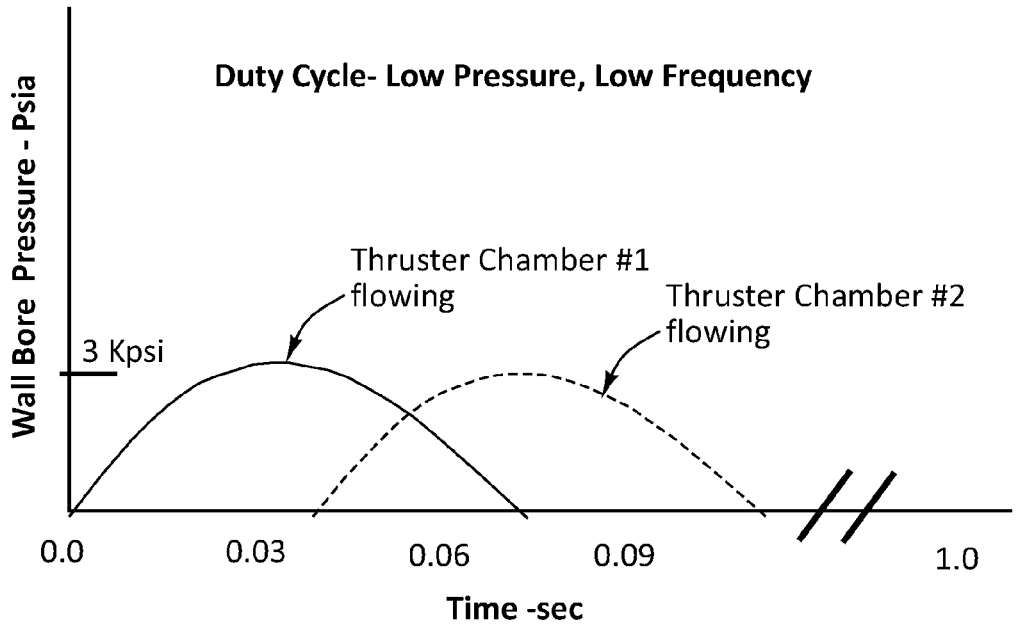
FIG. 17 is a chart of a relatively low pressure, low frequency duty cycle for the pneumatic fracturing tool.

It should be appreciated that the duty cycle can be configured with an infinite combination of pulse amplitudes and frequencies bounded by extreme formation fracking requirements. FIG. 16 shows a graph of a relatively high pressure, high frequency duty cycle. This duty cycle can be used to fracture an extremely hard formation. FIG. 17 shows a graph of a relatively low pressure, low frequency duty cycle. This duty cycle can be used to fracture an extremely soft rock formation. The only limit on the number of pulses in the duty cycle is the amount of propellant 82 in the pneumatic fracturing tool 54.

In one embodiment, the pneumatic fracturing tool 54 can be configured to fracture a soft formation at approximately 3500 psia with a transient pressure response of approximately 0.03 second to full pressure amplitude. On the other extreme, the pneumatic fracturing tool 54 can be configured to fracture a hard formation at approximately 15,000 psia with a transient pressure response of approximately 0.015 seconds to full pressure amplitude.

The duty cycle can be configured to open the valves 102 in any sequence or order. In one embodiment, the tool controller 126 is configured to open all of the valves 102 at the same time to release pressure pulses from all of the nozzle assemblies 94 in all of the gas deployment assemblies 64. In another embodiment, the tool controller 126 is configured to selectively open the valves 102.

Figures 18, 19, 20:
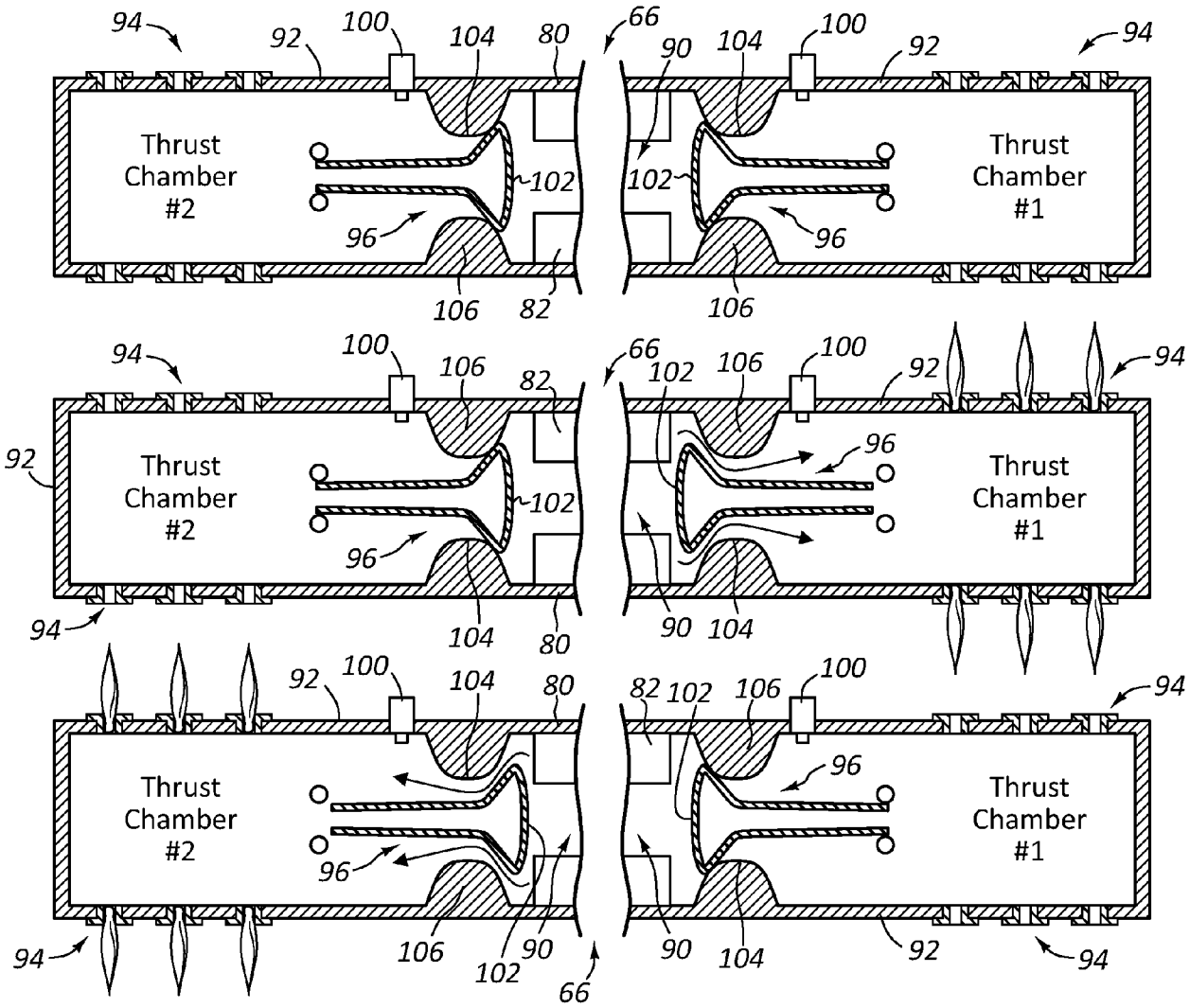
FIGS. 18-20 are cross-sectional views of one embodiment of a gas generation assembly coupled on both ends to separate gas deployment assemblies; the position of the valves is shown over the course of a single duty cycle.

In one embodiment, the tool controller 126 is configured to open the valves 102 according to the sequence shown in FIGS. 18-20. FIG. 18 shows that the valves 102 are closed when the propellant 82 is first ignited. Once the gas generation chamber 90 reaches a certain pressure, the tool controller 126 opens the valve 102 to thrust chamber #1 as shown in FIG. 19. It should be noted that the tool controller 126 receives pressure data from a pressure transducer positioned in the gas generation chamber 90. The valve 102 is opened enough to allow hot gas to flow to the nozzle assemblies 94 in thrust chamber #1 while maintaining the pressure in the gas generation chamber 90. The tool controller 126 monitors the pressure in thrust chamber #1 using a pressure transducer 100. When the pressure stops rising and begins to fall, the tool controller 126 recognizes that this signifies that the rock formation is beginning to fracture.

The ability to measure the pressure at which the rock formation fractures provides a number of advantages. For example, the user can retrieve this data from a previous fracturing operation and use it to program the duty cycle of a subsequent fracturing operation (see discussion of this above). This makes it possible to tune the duty cycle to ensure that a fracturing event is promoted.

The tool controller 126 follows the duty cycle and closes the valve 102 to the thrust chamber #1 and opens the valve 102 to the thrust chamber #2 as shown in FIG. 20. Hot gas flows through the thrust chamber #2 in the same manner as it flowed through the thrust chamber #1. The tool controller 126 continues to open and close the valves 102 in accordance with the selected duty cycle until the fracturing operation is finished. FIGS. 16-17 show examples of duty cycles that correspond to this procedure.

In one embodiment, the valves 102 are never completely closed during the fracturing operation. The valve 102 that is considered to be closed can be left slightly open to prevent debris and other material from flowing into the pneumatic fracturing tool 54 through the nozzle assemblies 94.

The fracturing operation for a given pneumatic fracturing tool 54 is complete when the propellant 82 has completely burned out. At this point, the pneumatic fracturing tool 54 is extracted from the drill hole and any useful data is copied from the tool controller 126 to the computer 58. In one embodiment, the pneumatic fracturing tool 54 is not designed to be reused and is disposed of. In another embodiment, the pneumatic fracturing tool 54 can be configured to be reused over and over.

Figure 21:
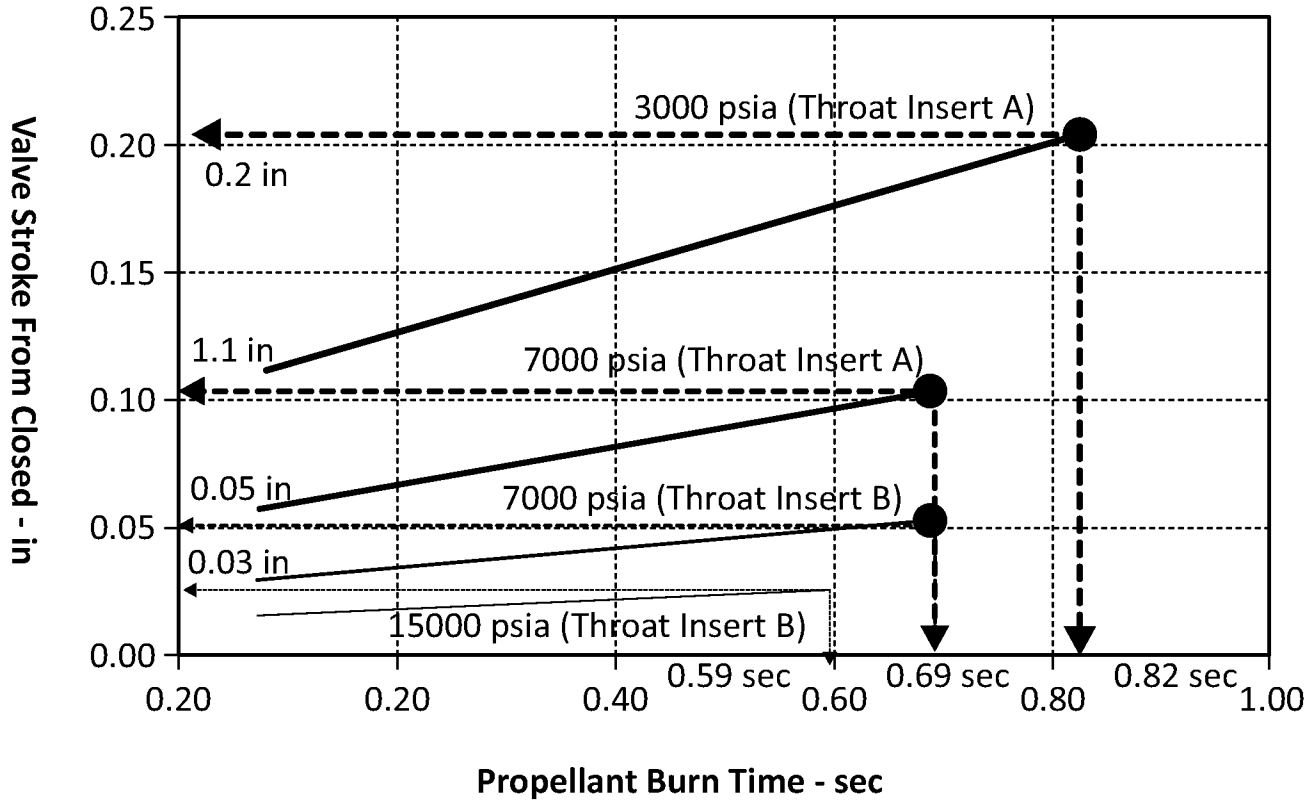
FIG. 21 is a chart of the proportional valve positions that correspond to various pressures in the gas generation chamber of the pneumatic fracturing tool.
Figure 22:
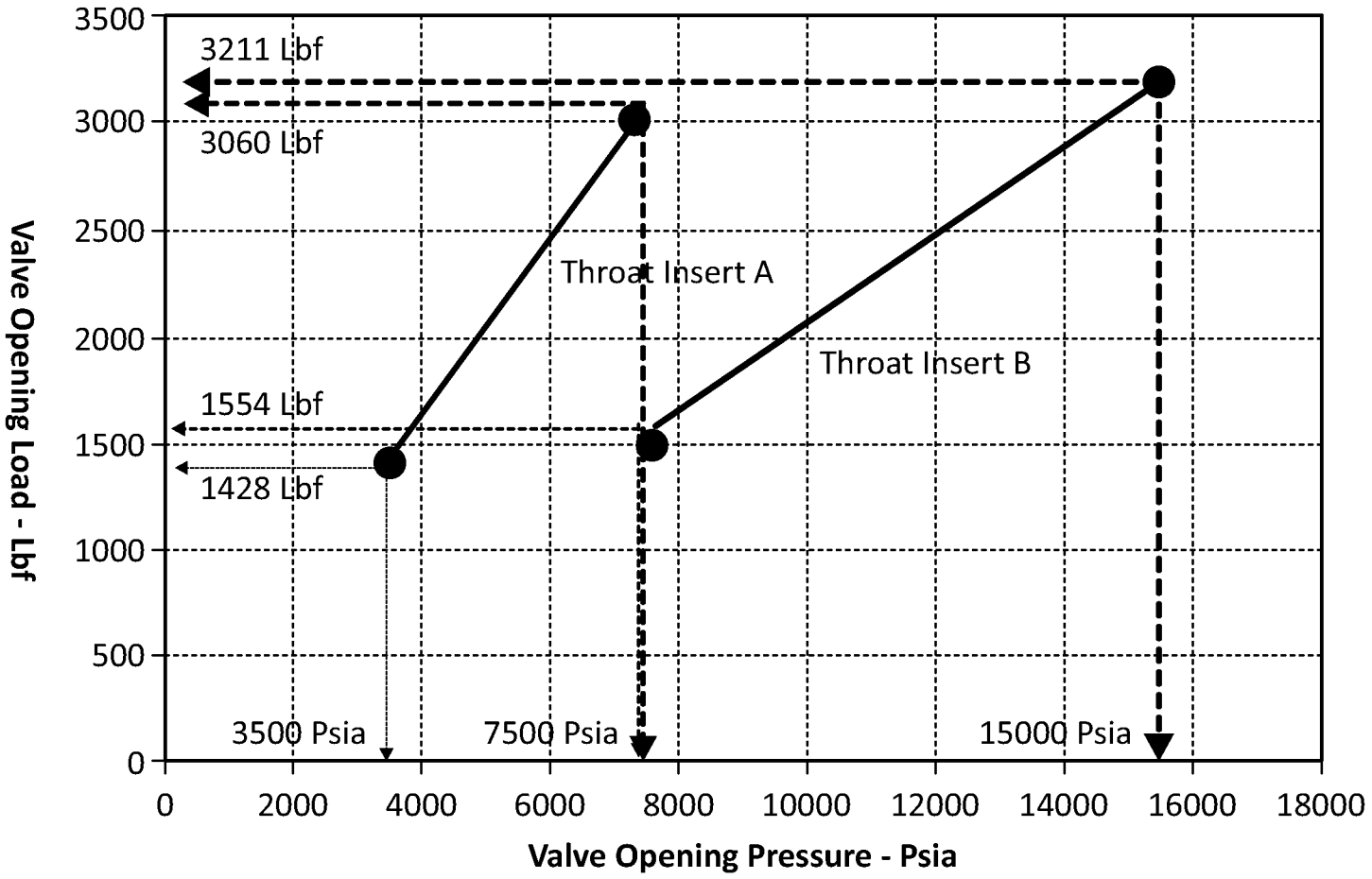
FIG. 22 is a chart of the valve opening load versus the valve opening pressure for two different valve throat inserts.

FIGS. 21-22 show that different throat inserts can be positioned in the throat of the valve assemblies 96 to reduce the loading on the actuators 98 to less than approximately 3200 lbf opening loads. FIG. 21 shows the proportional valve positions required to maintain the desired pressure in the gas generation chamber 90 at the extreme pressure regimes along with the overall operating time of the propellant burn.

FIG. 22 shows that throat insert A (diameter=0.76 inches) can be used to provide gas pressures from approximately 3,000 psia to approximately 7,000 psia and throat insert B (diameter 0.54 inches) can be used to provide gas pressures from approximately 7,000 psia to 15,000 psia. The load on the actuators 98 does not exceed approximately 3,200 lbf if throat insert A is used for lower pressures and throat insert B is used for higher pressures. It should be appreciated that the diameter of the throat inserts can change significantly depending on the application, size of the pneumatic fracturing tool 54, and the like.

It should be appreciated that the fracturing method described above can be changed in a variety of ways. For example, different well hole bores have different characteristics—i.e., diameter, depth, rock formations, and the like. The method used to fracture the rock formation can be adjusted to account for these differences.

Other Uses

It should be appreciated that the pneumatic fracturing system 50 can be used in a variety of other applications besides fracturing rock formations in deep well bores. For example, the pneumatic fracturing system 50 can be used in the surface mining and tunnel construction industry to fracture rocks in a controlled manner. Also, the pneumatic fracturing system 50 can be used as an accessory to air dropped penetrator weapons that compromise hard deeply buried enemy targets.

The surface mining and tunnel construction industry both use high explosives in down hole applications to disrupt and displace rock for excavation. The explosives typically detonate with results that create hazardous flying debris, over stimulus of the rock beyond planned effects, and not breaking the rock to an aggregate size that facilitates excavation and transport. The finely tuned nature of the pneumatic fracturing system 50 can facilitate a more precise disruption of the formation by coupling mechanical advantage to the resonance frequency of the rock species.

The pneumatic fracturing system 50 can be adapted for military use by coupling the device to a warhead penetrator to address hardened deeply buried enemy targets. The rapid pressure pulsing of the pneumatic fracturing system 50 is expected to disrupt the hardened target substrate by cavitating a passageway deeper than existing weapon designs.

Example 1

The following is a detailed step by step process that can be used to fracture a rock formation using the pneumatic fracturing system 50. The first step is to ship and setup the pneumatic fracturing system 50 hardware and energetics (e.g., propellant, explosive charges, and the like). The control station is transported to the job site by the operator. The inert components of the pneumatic fracturing tool 54 are transported from the manufacturing facility to the job site using a commercial transport company.

The energetic components of the pneumatic fracturing tool 54 (i.e., propellant, igniter, explosive charges, and the like) are shipped separately from the inert components by trained personnel. The energetic components are combined with the inert components at the job site. The pneumatic fracturing tool 54 is stored at the job site in an explosive magazine until it is ready to be deployed by trained personnel. The pneumatic fracturing tool 54 is stored in a manual safe condition—i.e., with the safety flag installed.

The second step is to program the pneumatic fracturing tool 54. The operator connects a laptop computer to the pneumatic fracturing tool 54 via special harnessing. The operator then powers on the processor in the pneumatic fracturing tool 54 via a manual power on interface—i.e., a switch. The laptop notifies the operator when a connection is established with the pneumatic fracturing tool 54 and it is ready to accept the duty cycle file. The operator then selects and/or creates a custom duty cycle file and transfers it to the pneumatic fracturing tool 54. The laptop is disconnected from the pneumatic fracturing tool 54 using the special harnessing and re-connected through the deployment telemetry interface. The pneumatic fracturing tool 54 remains in the power-on state.

The third step is to deploy the pneumatic fracturing tool 54. The pneumatic fracturing tool 54 is integrated to the special pneumatic fracturing tool 54 deployment tooling, which is used to lower the pneumatic fracturing tool 54 into position. The pneumatic fracturing tool 54 logs all telemetry data during deployment in a ruggedized memory module. The control station operator can optionally monitor the telemetry data via a fiber optic cable or conventional data cable to verify health status, readiness, and the like of the pneumatic fracturing tool 54.

The fourth step is to operate the pneumatic fracturing tool 54. Once the pneumatic fracturing tool 54 is in the desired position, the control station operator initiates the fracturing process via a special initiation communication. Upon receipt of the communication, the processor in the pneumatic fracturing tool 54 activates and initiates the high power battery. When the battery reaches the target voltage, the processor will initiate the burn process. The pneumatic fracturing tool 54 logs all telemetry data during operation via the ruggedized memory module. Optionally, the telemetry data can be sent above ground in real time during the fracturing process.

The fifth step is to extract the pneumatic fracturing tool 54. Upon reaching the surface, the pneumatic fracturing tool 54 is manually switched back to the safe condition. The operator retrieves the stored telemetry data from the ruggedized memory module of the pneumatic fracturing tool 54.

Example 2

Figure 23:
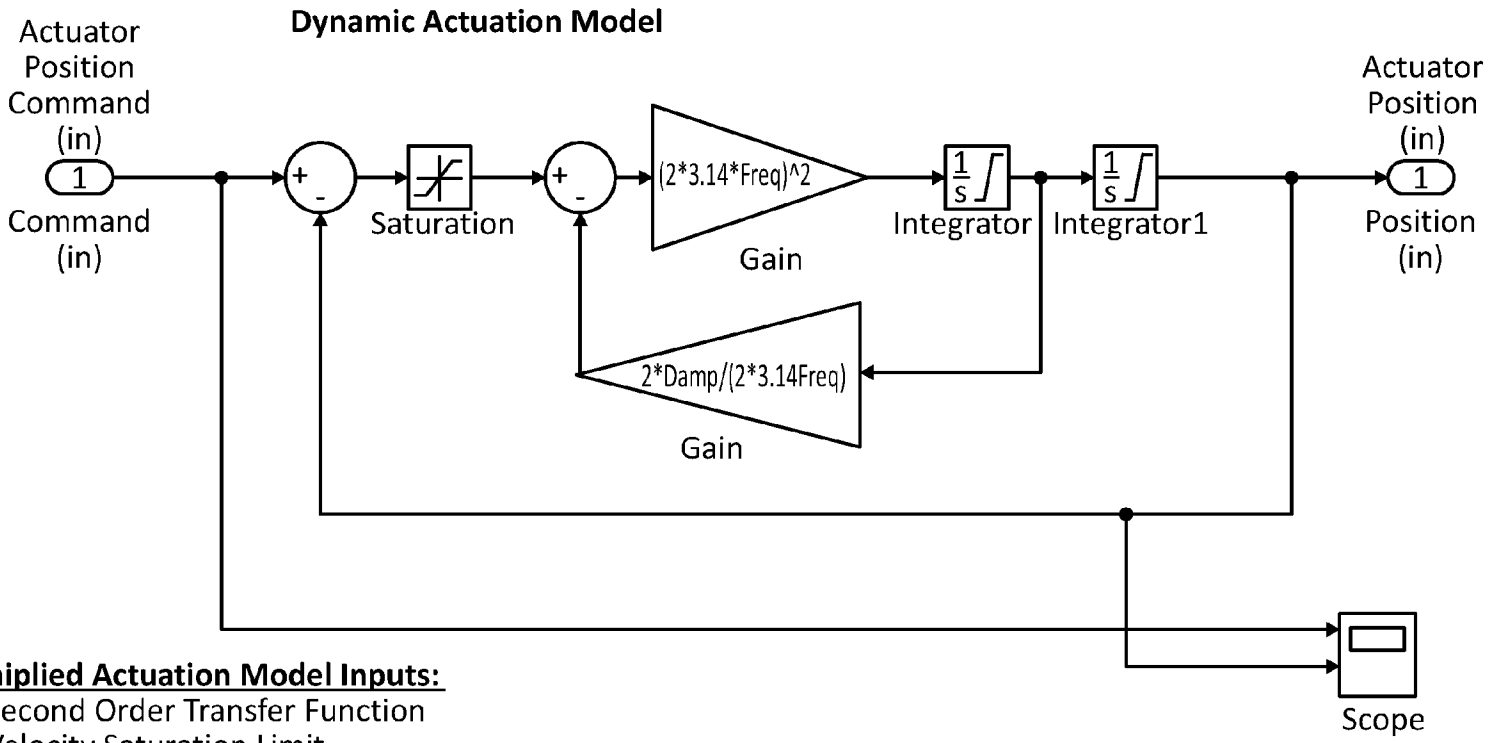
FIGS. 23-24 are diagrams showing the parameters of a ballistic dynamic simulation of the hot gas valve and electromechanical actuators for the pneumatic fracturing tool.
Figure 24:
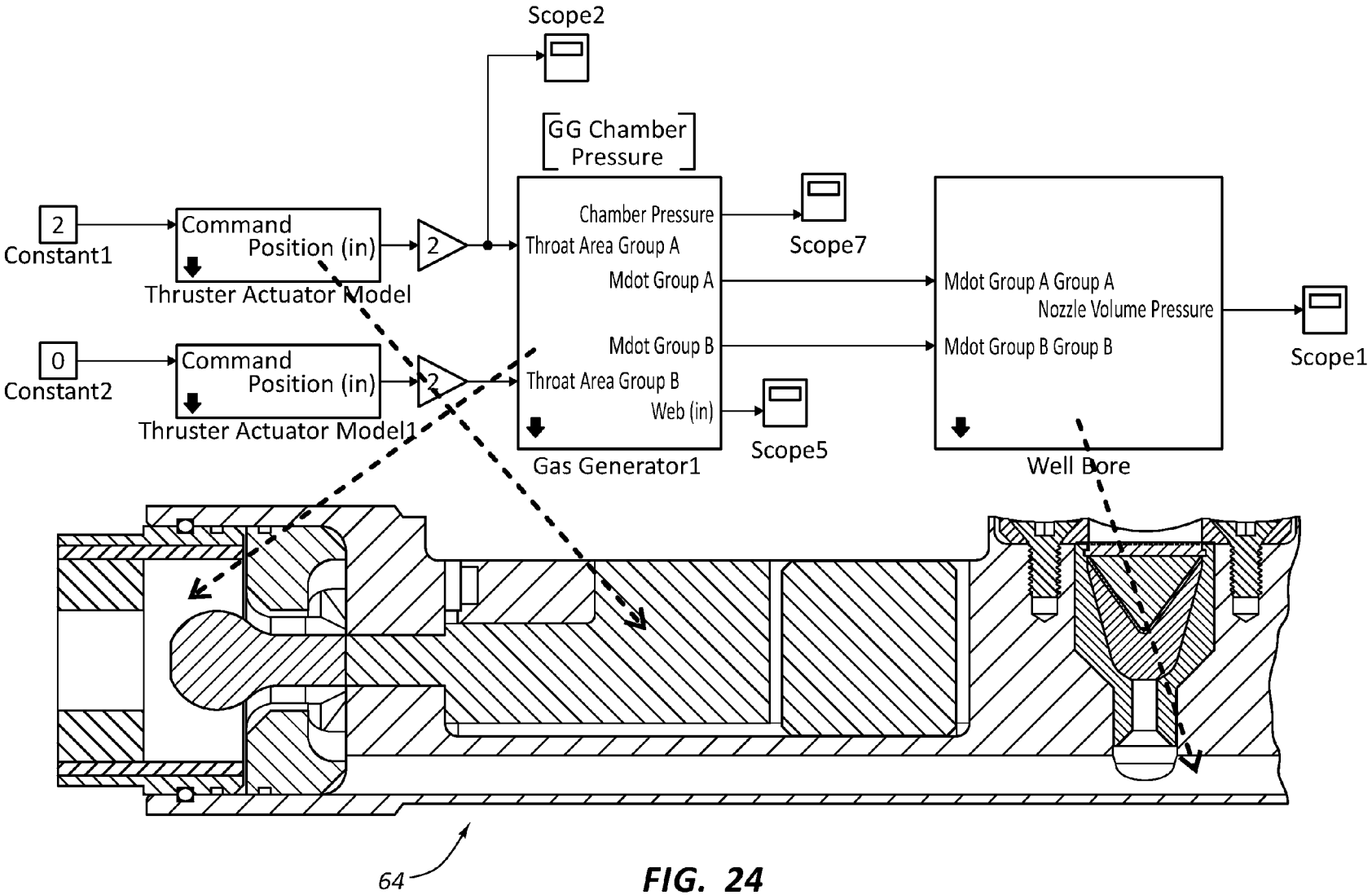
Figure 25:
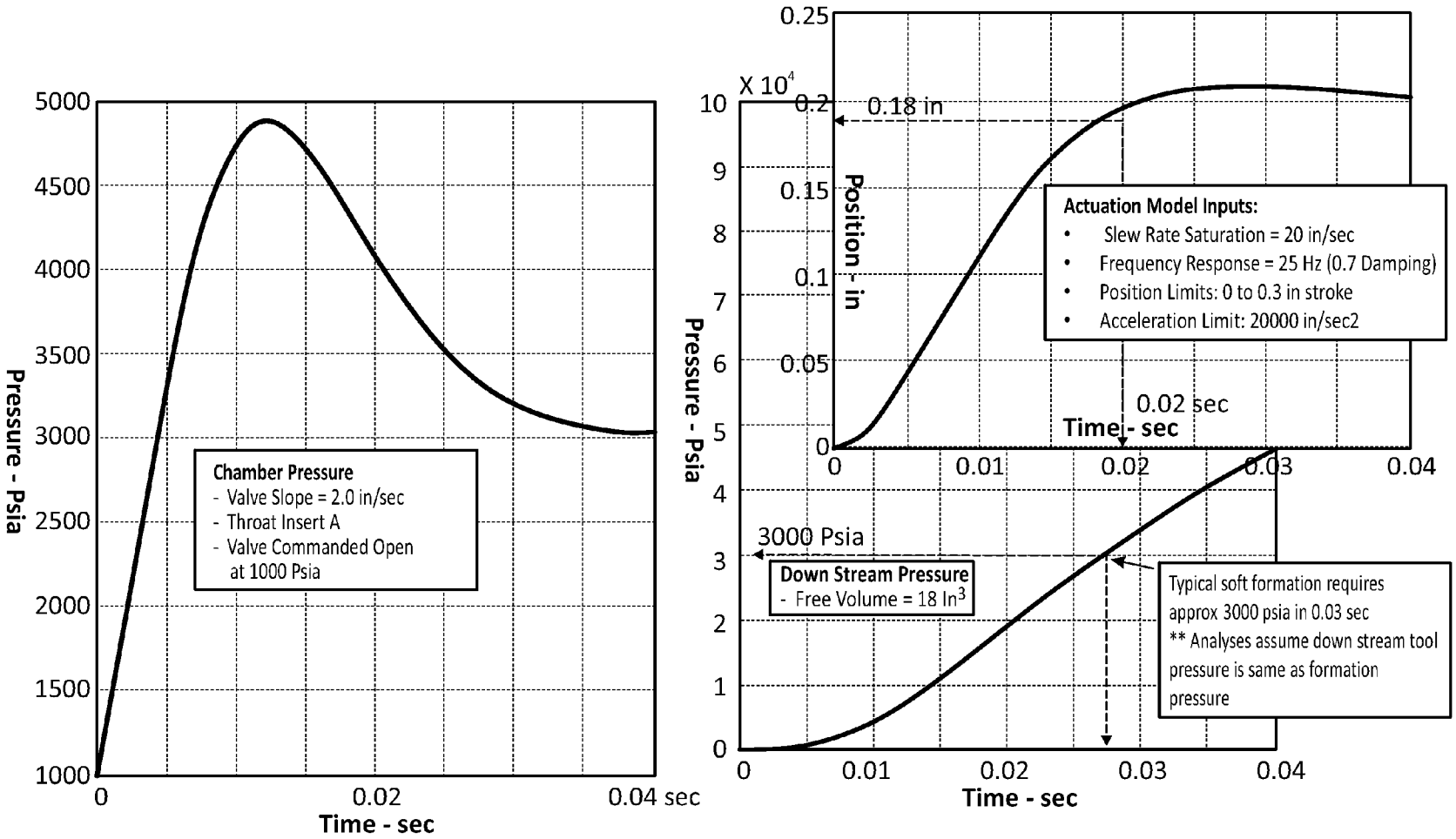
FIGS. 25-26 contain charts showing that the results of the ballistic dynamic simulation in referenced in connection with FIGS. 23-24.
Figure 26:
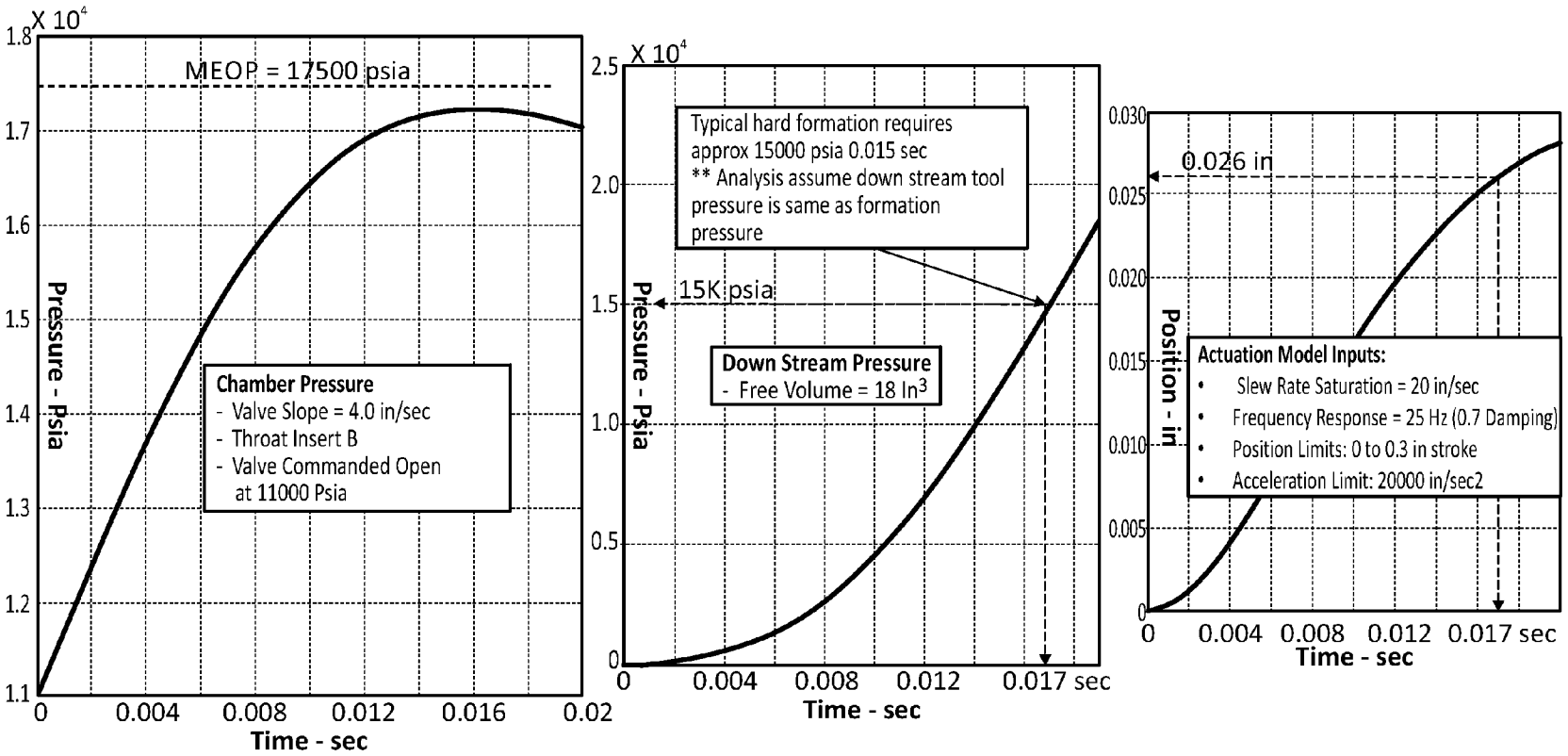

A ballistic dynamic simulation of the hot gas valve and electromechanical actuation was performed using Matlab Simulink software. The simulation parameters are shown in FIGS. 23-24. The simulation examined the first pulse of both the "soft" and "hard" rock extreme duty cycle cases (described above). The results showed that with the propellant ballistic properties, design volumes/geometries, and actuator performance characteristics noted in the FIGS. 25-26, the system is controllable and representative pressure and amplitude profiles can be realized that match the requirements for the extreme rock formation fracturing cases. Overall, FIGS. 23-26 show the results of the ballistic dynamic simulation that collectively specify the dynamic requirement for the hot gas valve and electromechanical actuation.

It should be appreciated that some components, features, and/or configurations may be described in connection with only one particular embodiment, but these same components, features, and/or configurations can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments can be combined together in any manner and such combinations are expressly contemplated and disclosed by this statement.

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure the term shall mean," etc.).

References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope.

The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be given their broadest interpretation in view of the prior art and the meaning of the claim terms.

As used herein, spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

All disclosed ranges are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

What is claimed is:

1. A pneumatic fracturing process comprising:

lowering a pneumatic fracturing tool into a well bore, the pneumatic fracturing tool comprising:

a tool body having a gas jet section;

a gas jet valve; and a gas jet opening in the gas jet section of the tool body;

wherein the gas jet section is in fluid communication with the gas jet valve and faces outwardly from the tool body;

burning solid fuel to generate pressurized gas;

actuating the gas jet valve in accordance with a duty cycle to variably pulsate the pressurized gas through the gas jet opening toward a rock formation external to the pneumatic fracturing tool; and tuning the duty cycle to a resonant frequency of the rock formation.

2. The pneumatic fracturing process of claim 1 comprising using data provided by the pneumatic fracturing tool to tune the duty cycle.

3. The pneumatic fracturing process of claim 1:

wherein the gas jet section is a first gas jet section, the gas jet valve is a first gas jet valve, and the gas jet opening is a first gas jet opening; and wherein the pneumatic fracturing tool comprises:

the tool body having a second gas jet section;

a second gas jet valve; and a second gas jet opening in the second gas jet section of the tool body;

wherein the second gas jet section is in fluid communication with the second gas jet valve and faces outwardly from the tool body; and wherein the pneumatic fracturing process further comprises:

actuating the second gas jet valve to variably pulsate pressurized gas through the second gas jet opening toward the rock formation external to the pneumatic fracturing tool.

4. The pneumatic fracturing process of claim 3 comprising actuating the second gas jet valve in accordance with the duty cycle.

5. The pneumatic fracturing process of claim 1 further comprising, after actuating the gas jet valve to variably pulsate the pressurized gas, extracting oil or gas from the well bore.

6. The pneumatic fracturing process of claim 1 wherein all of the solid fuel is included on-board the pneumatic fracturing tool in the well bore.

7. The pneumatic fracturing process of claim 1 wherein actuating the gas jet valve in accordance with the duty cycle includes varying the amplitude of pressurized gas pulses through the gas jet opening.

8. The pneumatic fracturing process of claim 1 comprising perforating a well bore casing using the pneumatic fracturing tool before actuating the gas jet valve in accordance with the duty cycle.

9. The pneumatic fracturing process of claim 1 wherein actuating the gas jet valve comprises opening and closing the gas jet valve to variably pulsate the pressurized gas through the gas jet opening.

10. The pneumatic fracturing process of claim 1 wherein the only fluid that passes through the gas jet valve is the pressurized gas produced by burning the solid fuel.

11. A pneumatic fracturing hydrocarbon recovery process comprising:

lowering a pneumatic fracturing tool through a well bore, the pneumatic fracturing tool comprising:

a tool body;

a first gas jet valve;

a second gas jet valve;

a first plurality of gas jet openings in a first section of the tool body, the first plurality of gas jet openings being in fluid communication with the first gas jet valve; and a second plurality of gas jet openings in a second section of the tool body, the second plurality of gas jet openings being in fluid communication with the second gas jet valve;

burning solid fuel to generate pressurized gas;

actuating the first gas jet valve to variably pulsate the pressurized gas through the first plurality of gas jet openings;

actuating the second gas jet valve to variably pulsate the pressurized gas through the second plurality of gas jet openings; and extracting hydrocarbon material through the well bore.

12. The pneumatic fracturing process of claim 11:

wherein the well bore includes a main well bore and an offshoot well bore extending at an angle from the main well bore; and wherein the lowering step includes moving the pneumatic fracturing tool through the main well bore and offshoot well bore.

13. The pneumatic fracturing process of claim 11 comprising actuating the first gas jet valve to variably pulsate the pressurized gas through the first plurality of gas jet openings at a gas jet pulsing frequency determined with respect to an aspect of a rock formation.

14. The pneumatic fracturing process of claim 12 comprising actuating the first gas jet valve to variably pulsate the pressurized gas through the first plurality of gas jet openings at a gas jet pulsing frequency determined with respect to an aspect of a rock formation.

15. The pneumatic fracturing process of claim 14 comprising actuating the second gas jet valve to variably pulsate the pressurized gas through the second plurality of gas openings at a gas jet pulsing frequency determined with respect to a resonant frequency of the rock formation.

16. The pneumatic fracturing process of claim 15 also comprising downloading operational data from the pneumatic fracturing tool.

17. The pneumatic fracturing process of claim 15:

wherein the pneumatic fracturing tool includes a protective outer housing; and wherein the process comprises, after lowering the pneumatic fracturing tool through the well bore, creating a plurality of holes in the protective outer housing.

18. The pneumatic fracturing process of claim 11 wherein all of the solid fuel is included on-board the pneumatic fracturing tool in the well bore.

19. The pneumatic fracturing process of claim 11 comprising varying the amplitude of pressurized gas pulses through the first plurality of gas jet openings and the second plurality of gas jet openings.

20. The pneumatic fracturing process of claim 11 comprising perforating a well bore casing using the pneumatic fracturing tool before actuating the first gas jet valve or the second gas jet valve to variably pulsate the pressurized gas through the first plurality of gas jet openings or the second plurality of gas jet openings.

21. The pneumatic fracturing process of claim 11 wherein actuating the first gas jet valve comprises opening and closing the first gas jet valve to variably pulsate the pressurized gas through the first plurality of gas jet openings and actuating the second gas jet valve comprises opening and closing the second gas jet valve to variably pulsate the pressurized gas through the second plurality of gas jet openings.

22. The pneumatic fracturing process of claim 11 wherein actuating the first gas jet valve and actuating the second gas jet valve comprises alternating between a first configuration where the first gas jet valve is open and the second gas jet valve is closed and a second configuration where the first gas jet valve is closed and the second gas jet valve is open.

23. The pneumatic fracturing process of claim 11 wherein the pneumatic fracturing tool comprises a gas generation chamber positioned between the first section and the second section of the tool body.

24. The pneumatic fracturing process of claim 23 wherein the first gas jet valve and the second gas jet valve are positioned at opposite ends of the gas generation chamber.

25. The pneumatic fracturing process of claim 11 wherein the only fluid that passes through the first gas jet valve and the second gas jet valve is the pressurized gas produced by burning the solid fuel.

26. A pneumatic fracturing process utilizing a pneumatic fracturing tool, the process comprising:

lowering the pneumatic fracturing tool into a well bore;

burning solid fuel to generate pressurized gas; and actuating a valve to variably pulsate the pressurized gas into a rock formation external to the pneumatic fracturing tool;

wherein the only fluid that passes through the valve is the pressurized gas produced by burning the solid fuel.

27. The pneumatic fracturing process of claim 26 wherein all of the solid fuel is included on-board the pneumatic fracturing tool in the well bore.

28. The pneumatic fracturing process of claim 26 wherein actuating the valve to variably pulsate the pressurized gas includes varying the amplitude of pressurized gas pulses.

29. The pneumatic fracturing process of claim 26 comprising perforating a well bore casing using the pneumatic fracturing tool before actuating the valve to variably pulsate the pressurized gas.

30. The pneumatic fracturing process of claim 26 wherein actuating the valve comprises opening and closing the valve to variably pulsate the pressurized gas into the rock formation.

31. The pneumatic fracturing process of claim 26 wherein the pneumatic fracturing tool includes a protective outer housing, and wherein the process comprises perforating the protective outer housing and a well bore casing using an explosive charge before actuating the valve to variably pulsate the pressurized gas into the rock formation.

32. The pneumatic fracturing process of claim 26 comprising actuating the valve in accordance with a duty cycle tuned to a resonant frequency of the rock formation.

33. The pneumatic fracturing process of claim 26 wherein the valve is a gas jet valve;

wherein the pneumatic fracturing tool comprises:

a tool body;

the gas jet valve; and a gas jet opening in the tool body, the gas jet opening being in fluid communication with the gas jet valve; and wherein the process comprises:

actuating the gas jet valve to variably pulsate the pressurized gas through the gas jet opening and into the rock formation.

34. The pneumatic fracturing process of claim 26 wherein the valve is a first gas jet valve;

wherein the pneumatic fracturing tool comprises:

a tool body having a first section and a second section;

the first gas jet valve;

a second gas jet valve;

a first gas jet opening in the first section of the tool body, the first gas jet opening being in fluid communication with the first gas jet valve;

a second gas jet opening in the second section of the tool body, the second gas jet opening being in fluid communication with the second gas jet valve;

wherein the process comprises:

actuating the first gas jet valve to variably pulsate the pressurized gas through the first gas jet opening and into the rock formation; and actuating the second gas jet valve to variably pulsate the pressurized gas through the second gas jet opening and into the rock formation.

35. The pneumatic fracturing process of claim 34 wherein actuating the first gas jet valve comprises opening and closing the first gas jet valve to variably pulsate the pressurized gas through the first gas jet opening and actuating the second gas jet valve comprises opening and closing the second gas jet valve to variably pulsate the pressurized gas through the second gas jet opening.

36. The pneumatic fracturing process of claim 34 wherein actuating the first gas jet valve and actuating the second gas jet valve comprises alternating between a first configuration where the first gas jet valve is open and the second gas jet valve is closed and a second configuration where the first gas jet valve is closed and the second gas jet valve is open.

37. A pneumatic fracturing process utilizing a pneumatic fracturing tool, the process comprising:

lowering the pneumatic fracturing tool into a well bore;

burning fuel to generate pressurized gas; and actuating a valve to variably pulsate the pressurized gas into a rock formation external to the pneumatic fracturing tool;

wherein all of the fuel is included on-board the pneumatic fracturing tool in the well bore; and wherein the only fluid that passes through the valve is the pressurized gas produced by burning the fuel.

38. The pneumatic fracturing process of claim 37 wherein actuating the valve to variably pulsate the pressurized gas includes varying the amplitude of pressurized gas pulses.

39. The pneumatic fracturing process of claim 37 comprising perforating a well bore casing using the pneumatic fracturing tool before variably pulsating the pressurized gas.

40. The pneumatic fracturing process of claim 37 wherein actuating the valve comprises opening and closing the valve to variably pulsate the pressurized gas into the rock formation.

41. The pneumatic fracturing process of claim 37 wherein the pneumatic fracturing tool includes a protective outer housing, and wherein the process comprises perforating the protective outer housing and a well bore casing using an explosive charge before actuating the valve to variably pulsate the pressurized gas into the rock formation.

42. The pneumatic fracturing process of claim 37 comprising actuating the valve in accordance with a duty cycle tuned to a resonant frequency of the rock formation.

43. The pneumatic fracturing process of claim 37 wherein the valve is a gas jet valve;

wherein the pneumatic fracturing tool comprises:

a tool body;

the gas jet valve; and a gas jet opening in the tool body, the gas jet opening being in fluid communication with the gas jet valve; and wherein the process comprises:

actuating the gas jet valve to variably pulsate the pressurized gas through the gas jet opening and into the rock formation.

44. The pneumatic fracturing process of claim 37 wherein the valve is a first gas jet valve;

wherein the pneumatic fracturing tool comprises:

a tool body having a first section and a second section;

the first gas jet valve;

a second gas jet valve;

a first gas jet opening in the first section of the tool body, the first gas jet opening being in fluid communication with the first gas jet valve;

a second gas jet opening in the second section of the tool body, the second gas jet opening being in fluid communication with the second gas jet valve;

wherein the process comprises:

actuating the first gas jet valve to variably pulsate the pressurized gas through the first gas jet opening and into the rock formation; and actuating the second gas jet valve to variably pulsate the pressurized gas through the second gas jet opening and into the rock formation.

45. The pneumatic fracturing process of claim 44 wherein actuating the first gas jet valve comprises opening and closing the first gas jet valve to variably pulsate the pressurized gas through the first gas jet opening and actuating the second gas jet valve comprises opening and closing the second gas jet valve to variably pulsate the pressurized gas through the second gas jet opening.

46. The pneumatic fracturing process of claim 44 wherein actuating the first gas jet valve and actuating the second gas jet valve comprises alternating between a first configuration where the first gas jet valve is open and the second gas jet valve is closed and a second configuration where the first gas jet valve is closed and the second gas jet valve is open.

47. A pneumatic fracturing process utilizing a pneumatic fracturing tool, the process comprising:

lowering the pneumatic fracturing tool into a well bore lined with a well casing, the pneumatic fracturing tool including a protective outer housing;

perforating the protective outer housing and the well bore casing using an explosive charge;

burning solid fuel to generate pressurized gas; and actuating a valve to variably pulsate the pressurized gas into a rock formation external to the pneumatic fracturing tool;

wherein the protective outer housing is perforated before actuating the valve to variably pulsate the pressurized gas into the rock formation.

48. The pneumatic fracturing process of claim 47 wherein actuating the valve to variably pulsate the pressurized gas includes varying the amplitude of pressurized gas pulses.

49. The pneumatic fracturing process of claim 47 comprising perforating a well bore casing using the pneumatic fracturing tool before actuating the valve to variably pulsate the pressurized gas.

50. The pneumatic fracturing process of claim 47 comprising actuating the valve in accordance with a duty cycle tuned to a resonant frequency of the rock formation.

51. The pneumatic fracturing process of claim 47 wherein the valve is a gas jet valve;

wherein the pneumatic fracturing tool comprises:

a tool body;

the gas jet valve; and a gas jet opening in the tool body, the gas jet opening being in fluid communication with the gas jet valve; and wherein the process comprises:

actuating the gas jet valve to variably pulsate the pressurized gas through the gas jet opening and into the rock formation.

52. The pneumatic fracturing process of claim 47 wherein the valve is a first gas jet valve;

wherein the pneumatic fracturing tool comprises:

a tool body having a first section and a second section;

the first gas jet valve;

a second gas jet valve;

a first gas jet opening in the first section of the tool body, the first gas jet opening being in fluid communication with the first gas jet valve;

a second gas jet opening in the second section of the tool body, the second gas jet opening being in fluid communication with the second gas jet valve;

wherein the process comprises:

actuating the first gas jet valve to variably pulsate the pressurized gas through the first gas jet opening and into the rock formation; and actuating the second gas jet valve to variably pulsate the pressurized gas through the second gas jet opening and into the rock formation.

53. The pneumatic fracturing process of claim 52 wherein actuating the first gas jet valve comprises opening and closing the first gas jet valve to variably pulsate the pressurized gas through the first gas jet opening and actuating the second gas jet valve comprises opening and closing the second gas jet valve to variably pulsate the pressurized gas through the second gas jet opening.

54. The pneumatic fracturing process of claim 52 wherein actuating the first gas jet valve and actuating the second gas jet valve comprises alternating between a first configuration where the first gas jet valve is open and the second gas jet valve is closed and a second configuration where the first gas jet valve is closed and the second gas jet valve is open.

* * * * *